US009502778B2

(12) United States Patent
Shinkai et al.

(10) Patent No.: US 9,502,778 B2
(45) Date of Patent: Nov. 22, 2016

(54) ANTENNA APPARATUS LESS SUSCEPTIBLE TO SURROUNDING CONDUCTORS AND DIELECTRICS

(71) Applicant: Panasonic Corporation, Osaka (JP)

(72) Inventors: Sotaro Shinkai, Osaka (JP); Takeshi Ohno, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 282 days.

(21) Appl. No.: 14/477,103

(22) Filed: Sep. 4, 2014

(65) Prior Publication Data

US 2014/0368396 A1 Dec. 18, 2014

Related U.S. Application Data

(63) Continuation of application No. PCT/JP2014/000127, filed on Jan. 14, 2014.

(30) Foreign Application Priority Data

Jan. 15, 2013 (JP) ..... 2013-004238

(51) Int. Cl.
*H01Q 19/30* (2006.01)
*H01Q 1/52* (2006.01)
(Continued)

(52) U.S. Cl.
CPC ..... *H01Q 19/30* (2013.01); *H01Q 1/243* (2013.01); *H01Q 1/38* (2013.01); *H01Q 1/52* (2013.01); *H01Q 1/521* (2013.01); *H01Q 9/065* (2013.01); *H01Q 13/28* (2013.01); *H01Q 19/28* (2013.01)

(58) Field of Classification Search
CPC ..... H01Q 19/30; H01Q 1/521; H01Q 13/28
See application file for complete search history.

(56) References Cited

U.S. PATENT DOCUMENTS 6,281,843 B1 * 8/2001 Evtioushkine ..... H01Q 1/38 343/700 MS
6,326,922 B1 * 12/2001 Hegendoerfer ..... H01Q 1/38 343/700 MS (Continued)

FOREIGN PATENT DOCUMENTS

JP 64-016725 1/1989
JP 2007-159129 6/2007

(Continued)

OTHER PUBLICATIONS

Translation of International Preliminary Report on Patentability and Written Opinion of the International Searching Authority issued Jul. 21, 2015 in International Application No. PCT/JP2014/000127.

(Continued)

*Primary Examiner* — Hoang V Nguyen
*Assistant Examiner* — Michael Bouizza
(74) *Attorney, Agent, or Firm* — Wenderoth, Lind & Ponack, L.L.P.

(57) ABSTRACT

An antenna apparatus is provided with: a dielectric substrate, a front array including a feed element and a plurality of parasitic elements, the feed element being formed on the dielectric substrate and having one radiation direction, and the plurality of parasitic elements being formed on the dielectric substrate in an area located in the radiation direction with respect to the feed element; and at least one side array including a plurality of parasitic elements formed on the dielectric a substrate in at least an area located in a direction other than the radiation direction with respect to the feed element. The plurality of parasitic elements of each side array are aligned substantially along the radiation direction.

12 Claims, 18 Drawing Sheets

(51) Int. Cl.

| | |
|---|---|
| ***H01Q 9/06*** | (2006.01) |
| ***H01Q 1/38*** | (2006.01) |
| ***H01Q 13/28*** | (2006.01) |
| ***H01Q 19/28*** | (2006.01) |
| ***H01Q 1/24*** | (2006.01) |

(56) References Cited

U.S. PATENT DOCUMENTS

| | | | |
|---|---|---|---|
| 7,847,737 | B2 | 12/2010 | Kuroda |
| 8,059,052 | B2 | 11/2011 | Kanno |
| 2007/0132591 | A1 | 6/2007 | Khatri |
| 2009/0015499 | A1 | 1/2009 | Kuroda |
| 2009/0195460 | A1 | 8/2009 | Kanno |
| 2009/0207088 | A1 | 8/2009 | Sato et al. |
| 2012/0293387 | A1 | 11/2012 | Ohno |
| 2013/0027268 | A1 | 1/2013 | Ohno et al. |

FOREIGN PATENT DOCUMENTS

| | | |
|---|---|---|
| JP | 2009-017515 | 1/2009 |
| JP | 2009-182948 | 8/2009 |
| JP | 2009-194844 | 8/2009 |
| JP | 2011-003972 | 1/2011 |
| JP | 2011-087241 | 4/2011 |
| WO | 2012/053223 | 4/2012 |
| WO | 2012/164782 | 12/2012 |

OTHER PUBLICATIONS

International Search Report issued Feb. 18, 2014 in International (PCT) Application No. PCT/JP2014/000127 with English translation.

* cited by examiner

ANTENNA APPARATUS LESS SUSCEPTIBLE TO SURROUNDING CONDUCTORS AND DIELECTRICS

CROSS-REFERENCE TO RELATED APPLICATIONS

This is a continuation application of International Application No. PCT/JP2014/000127, with an international filing date of Jan. 14, 2014, which claims priority of Japanese Patent Application No. 2013-004238 filed on Jan. 15, 2013, the content of which is incorporated herein by reference.

BACKGROUND

1. Technical Field

The present disclosure relates to an antenna apparatus having directivity in a particular direction. The present disclosure also relates to a wireless communication circuit and an electronic apparatus, which are provided with such an antenna apparatus.

2. Description of Related Art

In order to increase an antenna's directivity, an endfire array antenna is known, in which the endfire array antenna is provided with a feed element and a parasitic element array, the parasitic element array including a plurality of parasitic elements arranged in front of the feed element. The endfire array antenna has directivity in the direction to which the parasitic element array is located with respect to the feed element, and the endfire array antenna outputs and inputs radio waves in this direction.

Japanese Patent laid-open Publication No. 2009-182948 A discloses an endfire antenna achieving high gain characteristics under the conditions of a shortened substrate length in a dielectric substrate.

Japanese Patent laid-open Publication No. 2009-194844 A discloses an antenna apparatus including a feed element and a plurality of parasitic elements, in which the parasitic elements is arranged in parallel with the feed element.

Japanese Patent laid-open Publication No. 2009-017515 A discloses an antenna apparatus suppressing surface wave propagation by loading elements having resonance characteristics around a patch antenna area.

Japanese Utility-Model laid-open Publication No. S64-016725 U discloses an antenna provided with antenna elements of the Yagi antenna structure within a box.

International Publication WO 2012/164782 A discloses an endfire array antenna provided with a feed element and a parasitic element array, in which the parasitic element array includes a plurality of parasitic elements arranged in front of the feed element.

SUMMARY

The relative positional relationship of a feed element and parasitic elements is a factor in determining the directivity of an endfire array antenna. Therefore, their positional relationship is important. In the case of actually using an endfire array antenna in a certain electronic apparatus, there is a possibility that electronic components and circuits, etc., other than the antenna may be installed near the antenna. In this case, wiring of these electronic components and circuits may act as parasitic elements, and may affect the directivity of the endfire array antenna. In addition, the directivity of the endfire antenna may vary depending on the shape of a conductive pattern, the shape of a dielectric substrate, etc.

One non-limiting and exemplary embodiment provides an antenna apparatus less susceptible to surrounding conductors and dielectrics. In addition, the present disclosure provides a wireless communication circuit and an electronic apparatus, which are provided with such an antenna apparatus.

According to an antenna apparatus of a general aspect of the present disclosure, the antenna apparatus is provided with: a dielectric substrate; a front array including a feed element and a plurality of parasitic elements, the feed element being formed on the dielectric substrate and having one radiation direction, and the plurality of parasitic elements being formed on the dielectric substrate in an area located in the radiation direction with respect to the feed element; and at least one side array including a plurality of parasitic elements formed on the dielectric substrate in at least an area located in a direction other than the radiation direction with respect to the feed element. The plurality of parasitic elements of the front array configure a plurality of front sub arrays, each of the front sub arrays including a plurality of parasitic elements which are aligned along the radiation direction. The plurality of front sub arrays are provided in parallel to each other along the radiation direction such that the respective parasitic elements of two adjacent front sub arrays are close to each other. The plurality of parasitic elements of each side array are aligned substantially along the radiation direction.

Additional benefits and advantages of the disclosed embodiments will be apparent from the specification and Figures. The benefits and/or advantages may be individually provided by the various embodiments and features of the specification and drawings disclosure, and need not all be provided in order to obtain one or more of the same.

According to the present disclosure, it is possible to provide an antenna apparatus less susceptible to surrounding conductors and dielectrics.

DETAILED DESCRIPTION

Embodiments are described in detail below with appropriate reference to the drawings. It is noted that excessively detailed explanation may be omitted. For example, detailed explanation on the already well-known matter, and repeated explanations on substantially the same configurations may be omitted. It is intended to avoid excessive redundancy of the following explanation and facilitate understanding of those skilled in the art.

The inventor(s) provides accompanying drawings and the following explanation in order for those skilled in the art to fully understand the present disclosure, and does not intend to limit claimed subject matters by the drawings and explanation.

The XYZ coordinate system shown in each drawing is referred to for explanation.

1. First Embodiment

1.1. Entire System Configuration

Figure 1:
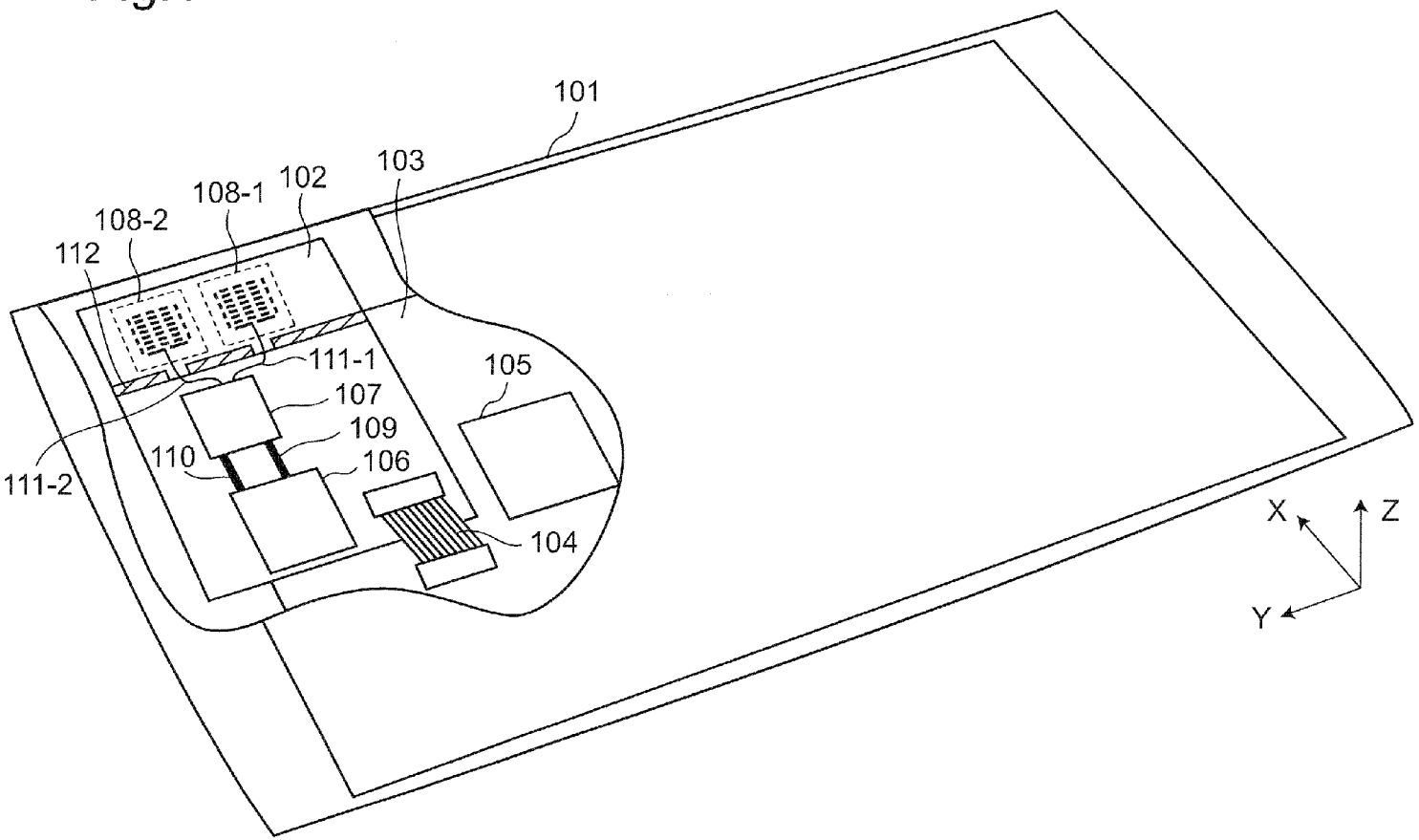
FIG. 1 is a perspective view showing an exemplary tablet terminal apparatus 101 provided with antenna apparatuses 108-1 and 108-2 according to a first embodiment.

FIG. 1 is a perspective view showing an exemplary tablet terminal apparatus 101 provided with antenna apparatuses 108-1 and 108-2 according to a first embodiment. In FIG. 1, a part of the tablet terminal apparatus 101 is removed to show the internal configuration of the tablet terminal apparatus 101.

The tablet terminal apparatus 101 is an electronic apparatus provided with: a wireless communication apparatus; and a signal processing apparatus configured to process signals transmitted or received by the wireless communication apparatus. The wireless communication apparatus is provided with antenna apparatuses 108-1 and 108-2, and a wireless communication circuit connected to the antenna apparatus.

The tablet terminal apparatus 101 is provided with two circuit boards, i.e., a wireless module board 102 operable as a wireless communication apparatus, and a host system board 103 operable as a signal processing apparatus. The wireless module board 102 and the host system board 103 are connected by a high-speed interface cable 104.

The wireless module board 102 is provided with, on a printed circuit board, a circuit configured to transmit or receive radio waves of, e.g., a 60 GHz band among radio waves of millimeter wave bands (30 GHz to 300 GHz). The 60 GHz band is used in, e.g., the WiGig standard for transmitting and receiving video and audio data at high speed, etc.

On the wireless module board 102, a baseband and MAC (Media Access Control) circuit 106, a radio frequency (RF) circuit 107, and antenna apparatuses 108-1 and 108-2 are provided. The baseband and MAC circuit 106 are connected to the RF circuit 107 through signal lines 109 and control lines 110. The RF circuit 107 is connected to the antenna apparatus 108-1 and 108-2 through feed lines 111-1 and 111-2, respectively.

The baseband and MAC circuit 106 controls signal modulation and demodulation, waveform shaping, and packet transmission and reception, etc. The baseband and MAC circuit 106 sends a modulated signal to the RF circuit 107 through the signal lines 109 during transmission, and demodulates a modulated signal received from the RF circuit 107 through the signal lines 109 during reception.

The RF circuit 107 performs frequency conversion between a frequency of the modulating signal and, e.g., a radio frequency in a millimeter wave band, and performs power amplification, waveform shaping, etc. of radio frequency signals. Therefore, during transmission, the RF circuit 107 performs the frequency conversion of the modulated signal received from the baseband and MAC circuit 106 through the signal lines 109, to generate a radio frequency signal (e.g., a WiGig signal), and sends the radio frequency signal to the antenna apparatuses 108-1 and 108-2 through the feed lines 111-1 and 111-2, respectively. During reception, the RF circuit 107 performs the frequency conversion of the radio frequency signal inputted through the feed lines 111-1 and 111-2, to generate the modulating signal, and sends the modulated signal to the baseband and MAC circuit 106 through signal lines 109 for demodulation.

The antenna apparatuses 108-1 and 108-2 are formed near an edge of the wireless module board 102, as conductive patterns of a printed circuit board. During transmission, the antenna apparatuses 108-1 and 108-2 radiate the radio frequency signal as a radio wave, the radio frequency signal is supplied from the RF circuit 107 through the feed lines 111-1 and 111-2. During reception, the antenna apparatuses 108-1 and 108-2 send currents, which are arose from a radio wave propagated over the air, to the RF circuit 107 through the feed lines 111-1 and 111-2, as a received radio frequency wave signal. If necessary, impedance matching circuits (not shown) may be provided on the feed lines 111-1 and 111-2 between the antenna apparatuses 108-1 and 108-2 and the RF circuit 107.

The two antenna apparatuses 108-1 and 108-2 may be used, one for transmission of a radio wave, and one for reception of a radio wave. Further, each of the antenna apparatuses 108-1 and 108-2 may be used for both transmission and reception of a radio wave, by time sharing, etc.

On the host system board 103, a host system circuit 105 is provided. The host system circuit 105 includes communication circuits and other processing circuits of the upper layers (application layer etc.) higher than the baseband and MAC circuit 106. For example, the host system circuit 105 includes a CPU, etc., configured to control operations of a display of the tablet terminal apparatus 101, etc.

The baseband and MAC circuit 106 communicate with the host system circuit 105 through the high-speed interface cable 104.

1.2. Configuration of Antenna Apparatus

Figure 2:
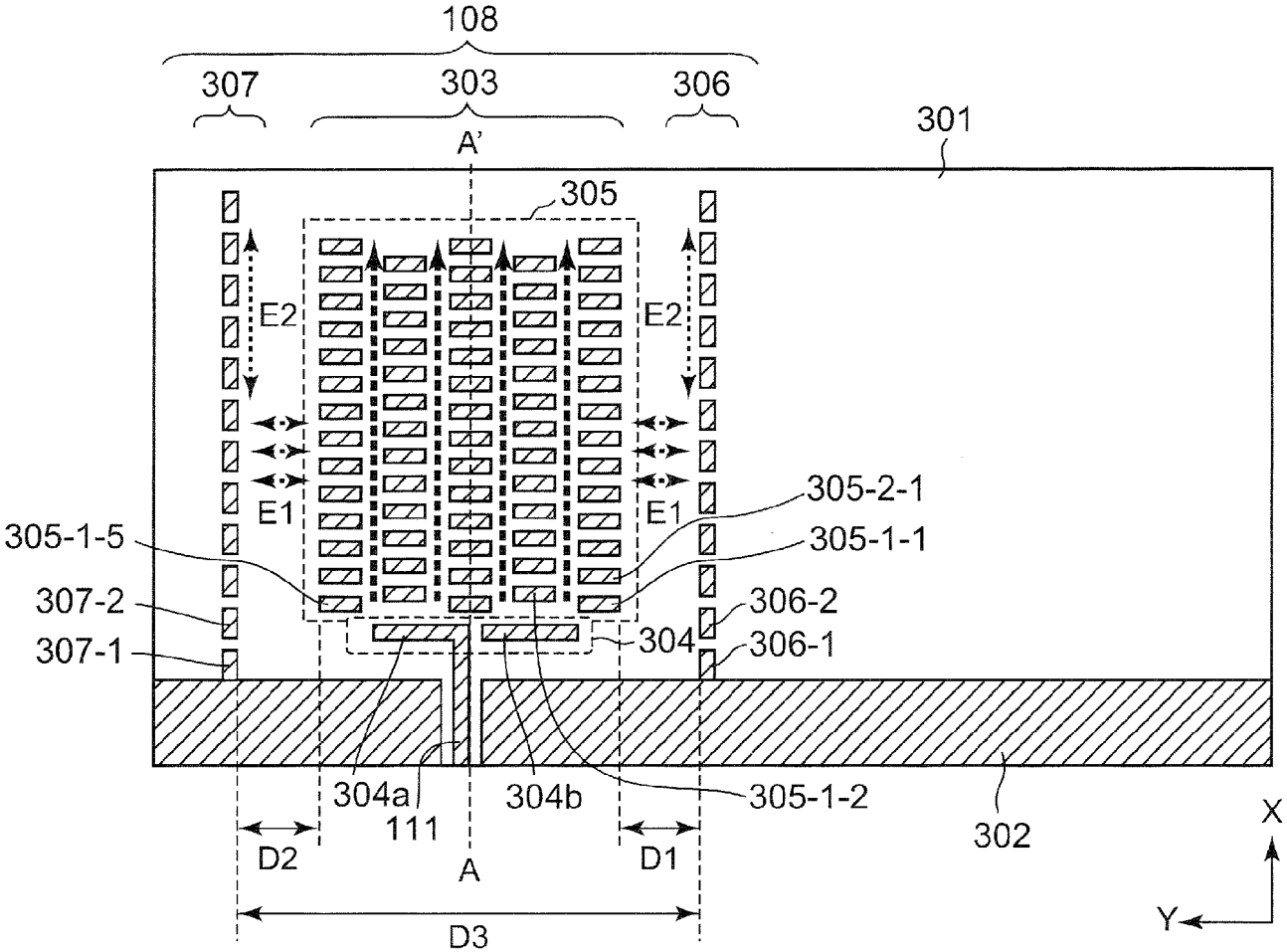
FIG. 2 is a plan view showing a detailed configuration of the antenna apparatuses 108-1 and 108-2 of FIG. 1.

FIG. 2 is a plan view showing a detailed configuration of the antenna apparatuses 108-1 and 108-2 of FIG. 1. An antenna apparatus 108 of FIG. 2 corresponds to each of the antenna apparatuses 108-1 and 108-2 of FIG. 1. FIG. 2 is a plan view of the antenna apparatus 108 seen from the above.

The antenna apparatus 108 of FIG. 2 is provided with: a dielectric substrate 301; a front array 305 including a feed element 304 and a plurality of parasitic elements, in which the feed element 304 is formed on the dielectric substrate 301 and having one radiation direction, and the plurality of parasitic elements is formed on the dielectric substrate 301 in an area located in the radiation direction with respect to the feed element 304; and at least one side array 306, 307 including a plurality of parasitic elements formed on the dielectric a substrate 301 in at least an area located in a direction other than the radiation direction with respect to the feed element 304 (areas located in a −Y direction and in a +Y direction of FIG. 2). The feed element 304 and the front array 305 operate as an endfire antenna 303 having a radiation direction in a +X direction of FIG. 2.

The dielectric substrate 301 corresponds to a part of the printed circuit board of the wireless module board 102 of FIG. 1.

The feed element 304 is a dipole antenna having a longitudinal direction along a direction perpendicular to the radiation direction (along a direction of a Y axis of FIG. 2). The feed element 304 includes feed element portions 304*a* and 304*b* substantially arranged along a straight line and adjacent to each other. A length of the entire feed element 304 (dipole antenna) is set to, e.g., about one half of an operating wavelength λ of the feed element 304 (i.e., a wavelength of the radio wave transmitted and received from the endfire antenna 303).

A ground conductor 302 is formed on the dielectric substrate 301 in an area located in a direction opposite to the radiation direction with respect to the feed element 304 (an area located in −X direction of FIG. 2). Since the ground conductor 302 is provided in this position, the feed element 304 has one radiation direction in the +X direction of FIG. 2. An electric potential of the ground conductor 302 serves as a ground potential of the wireless module board 102.

Figure 3:
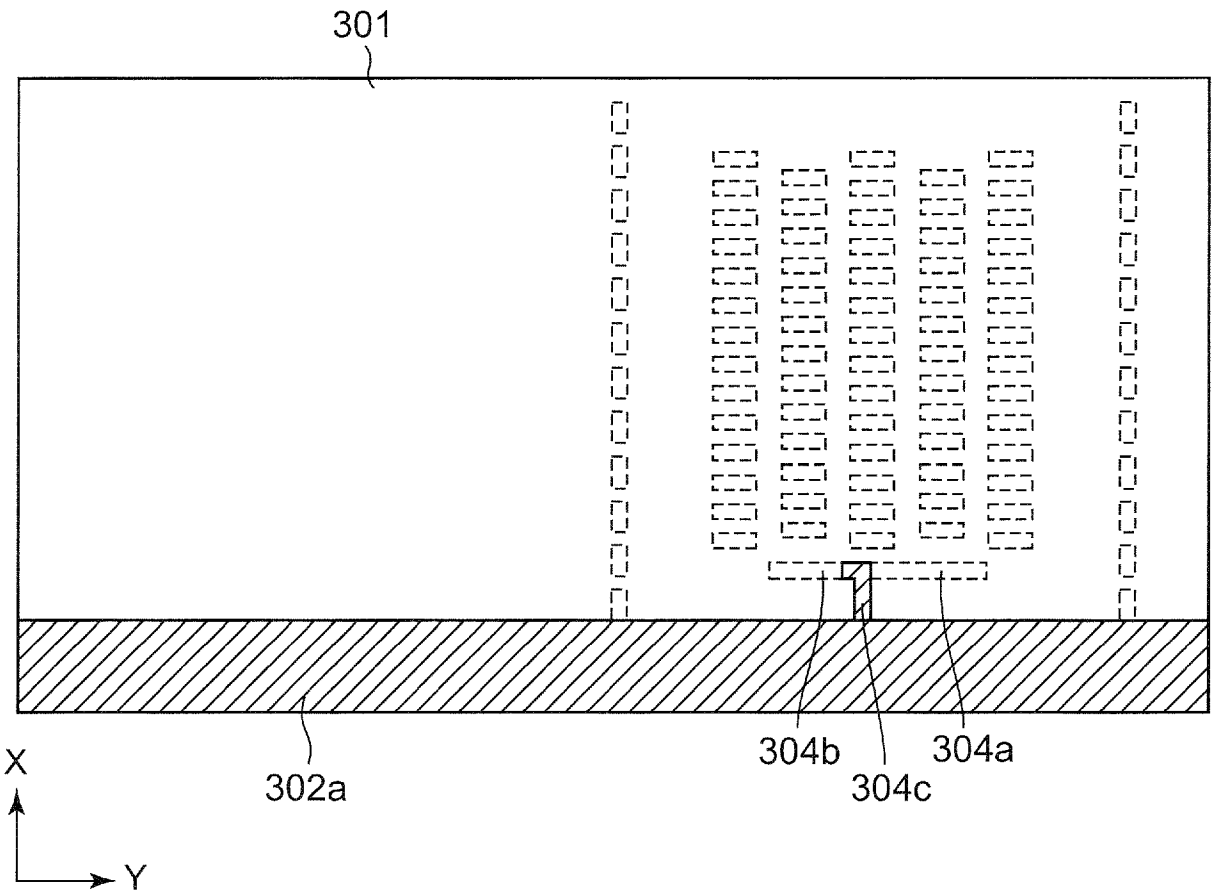
FIG. 3 is a plan view showing a bottom surface configuration of a dielectric substrate 301 of FIG. 2.

On the dielectric substrate 301, the feed line 111 is formed for connecting the feed element 304 to the RF circuit 107 of FIG. 1. The feed line 111 includes a conductor strip formed on a top surface of the dielectric substrate 301, and connected to the feed element portion 304*a*. FIG. 3 is a plan view showing a bottom surface configuration of the dielectric substrate 301 of FIG. 2. A ground conductor 302*a* is formed on the bottom surface of the dielectric substrate 301, so as to be opposite to the ground conductor 302 on the top surface of the dielectric substrate 301. In addition, a conductor strip 304*c* connected to the ground conductor 302*a* is formed on the bottom surface of the dielectric substrate 301. The conductor strip 304*c* is connected to the feed element portion 304*b* on the top surface of the dielectric substrate 301, through a via conductor (not shown) penetrating the dielectric substrate 301.

The plurality of parasitic elements of the front array 305 configure a plurality of front sub arrays, each of the front sub arrays including a plurality of parasitic elements which are aligned along the radiation direction. Referring to FIG. 2, the front array 305 includes: a rightmost front sub array including parasitic elements 305-1-1, 305-2-1, . . . , and so on; a second-rightmost front sub array including parasitic elements 305-1-2, 305-2-2, . . . , and so on; and similarly, up to a leftmost front sub array including parasitic elements 305-1-5, 305-2-5, . . . , and so on. The plurality of front sub arrays are provided in parallel to each other along the radiation direction such that the respective parasitic elements of two adjacent front sub arrays are close to each other.

The plurality of parasitic elements of the front array 305 have a longitudinal direction along a direction perpendicular to the radiation direction (along a direction of the Y axis of FIG. 2). Therefore, the longitudinal direction of the feed element 304 is substantially parallel to the longitudinal direction of each parasitic element of the front array 305.

A length of the longitudinal direction of each parasitic element of the front array 305 is shorter than a length of the longitudinal direction of each of the feed element portions 304*a* and 304*b*.

The plurality of front sub arrays of the front array 305 are provided such that in two adjacent front sub arrays, the respective parasitic elements of one front sub array, and the respective parasitic elements of the other front sub array are located at alternate positions.

The antenna apparatus 108 comprises a first side array 306 provided in one side with respect to a reference axis A-A' extending from the feed element 304 toward the radiation direction, and a second side array 307 provided in the other side with respect to the reference axis A-A'. The plurality of parasitic elements of each side array 306, 307 are aligned substantially along the radiation direction. Referring to FIG. 2, the side array 306 includes: parasitic elements 306-1, 306-2, . . . , and so on; and the side array 307 includes parasitic elements 307-1, 307-2, . . . , and so on. A distance D1 to the side array 306 from the feed element 304 and the front array 305 (i.e., from a −Y end of each parasitic element of the front array 305) is substantially equal to a distance D2 to the side array 307 from the feed element 304 and the front array 305 (i.e., from a +Y end of each parasitic element of the front array 305).

The distances D1 and D2 from the feed element 304 and the front array 305 to the respective side arrays 306 and 307 are set to be, e.g., about a distance between the parasitic elements of the front array 305, or more.

Figure 4:
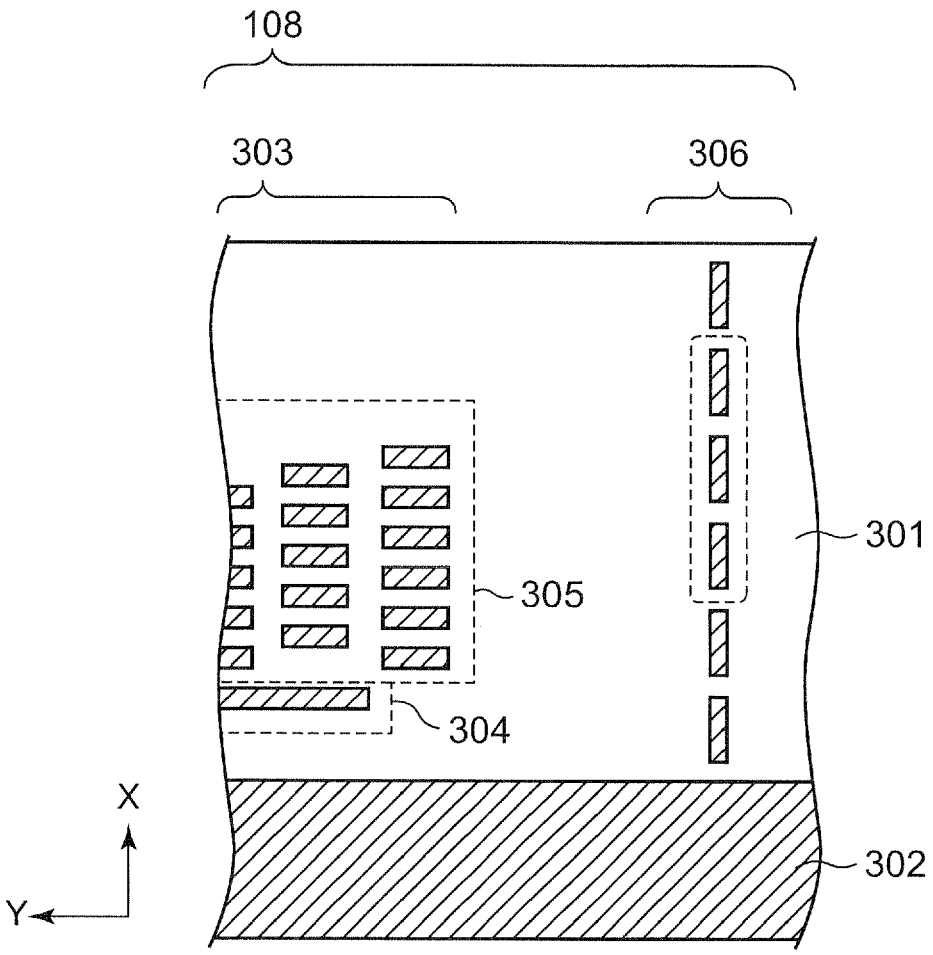
FIG. 4 is an enlarged view showing a part of an antenna apparatus 108 of FIG. 2.
Figure 5:
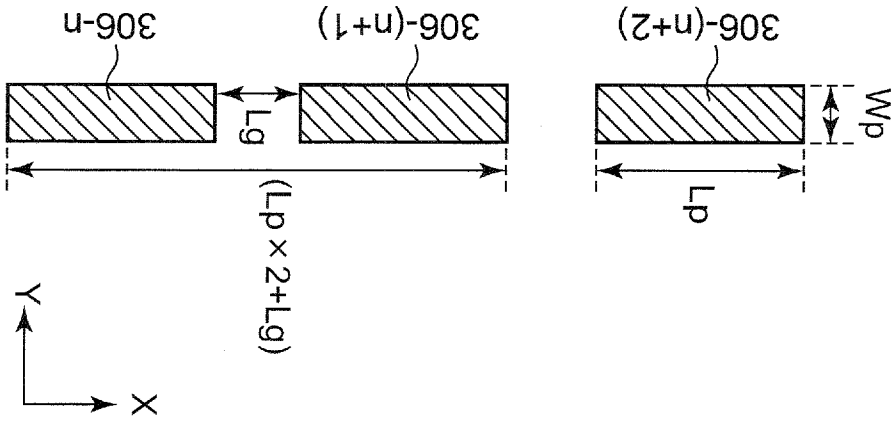
FIG. 5 is an enlarged view showing a part of parasitic elements of a side array 306 of FIG. 4.

FIG. 4 is an enlarged view showing a part of the antenna apparatus 108 of FIG. 2. FIG. 5 is an enlarged view showing a part of the parasitic elements of the side array 306 of FIG. 4. The respective parasitic elements of each of the side array 306 and 307 have their longitudinal direction along a longitudinal direction of the side array. Lp denotes a length in the longitudinal direction of each parasitic element 306-*n*, 306-(*n*+1), 306-(*n*+2), . . . , and so on, and Wp denotes its width, as shown in FIG. 5. In addition, Lg denotes a length of a gap between two parasitic elements adjacent to each other in the longitudinal direction of the side array 306. The parasitic elements of the side array 307 is also configured in a manner similar to that of the parasitic elements of the side array 306 of FIG. 5. In each of the side arrays 306 and 307, a sum of lengths in the longitudinal direction of two parasitic elements adjacent in the longitudinal direction of the side array, 2×Lp, and a length of a gap between the two parasitic elements, Lg, is, e.g., less than one half of an operating wavelength λ of the feed element 304 (2×Lp +Lg<λ/2). In this case, it is possible to suppress resonance of the parasitic elements of the side arrays 306 and 307 at the operating wavelength λ of the feed element 304.

The size and arrangement of the parasitic elements of the side arrays 306 and 307 are not limited to those shown in FIG. 5 (2×Lp +Lg<λ/2). A combination of other length may be used as long as it is possible to suppress resonance of the parasitic elements of the side arrays 306 and 307 at the operating wavelength λ of the feed element 304.

A distance D3 between both the side arrays 306 and 307 of the endfire antenna 303 is set to, e.g., about 1.5 times the operating wavelength λ of feed element 304, or more. In this case, it is possible to prevent decrease in performance of the antenna apparatus 108 due to electromagnetic coupling between the feed element 304 and the parasitic elements of the side arrays 306 and 307.

Figure 6:
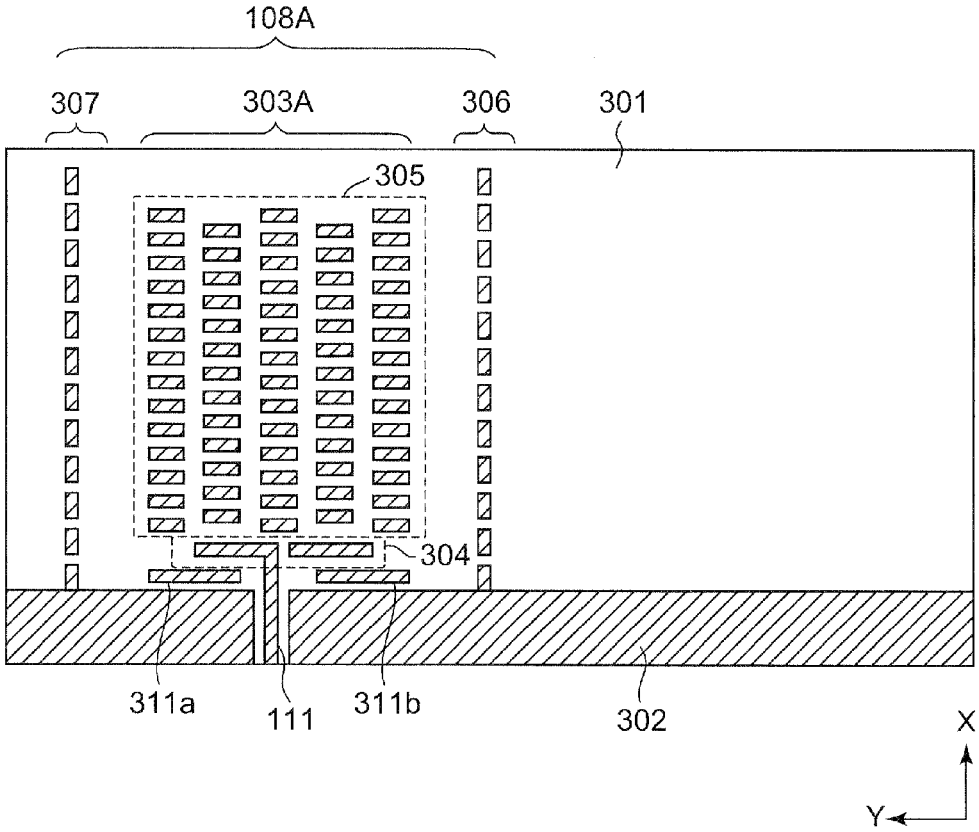
FIG. 6 is a plan view showing a configuration of an antenna apparatus 108A according to a modified embodiment of the first embodiment.

FIG. 6 is a plan view showing a configuration of an antenna apparatus 108A according to a modified embodiment of the first embodiment. The antenna apparatus 108A of FIG. 6 is provided with an endfire antenna 303A, the endfire antenna 303A is provided with the feed element 304 and the front array 305 of FIG. 2, and further provided with reflector elements 311*a* and 311*b*. The reflector elements 311*a* and 311*b* are formed on the dielectric substrate 301 and formed between the feed element 304 and the ground conductor 302, the reflector elements 311*a* and 311*b* having a longitudinal direction along the direction perpendicular to the radiation direction. According to the antenna apparatus 108A of FIG. 6, since the reflector elements 311*a* and 311*b* are provided in an area located in a direction opposite to the radiation direction (an area located in the −X direction of FIG. 2) with respect to the feed element 304, it is possible to efficiently direct a radio wave radiated from the feed element 304, in an endfire direction, and thus improve a FB (Front to Back) ratio, as compared with the antenna apparatus 108 of FIG. 2. Particularly, in the case that the number of front sub arrays increases and the size of the antenna apparatus 108A also increases in the direction perpendicular to the radiation direction, the reflector elements 311*a* and 311*b* are particularly effective in order to direct a radio wave in the +X direction. Also in the case of not providing the ground conductor 302, the reflector elements 311*a* and 311*b* are particularly effective in order to direct a radio wave in the +X direction.

1.3. Operation

The operation of the antenna apparatus 108 is explained with reference to FIG. 2.

First, the operation of the endfire antenna 303 is explained.

The plurality of front sub arrays are formed substantially parallel to each other such that that two adjacent front sub arrays form a pseudo-slot opening with a certain width.

In each of the front sub arrays, the parasitic elements adjacent to each other in the radiation direction are electromagnetically coupled to each other, and each of the front sub arrays operates as an electric wall extending in the radiation direction. The respective pseudo-slot openings are formed between two adjacent front sub arrays. Therefore, when the feed element 304 transmits or receives a radio wave, an electric field in the direction perpendicular to the radiation direction is generated in each of the pseudo-slot openings, and accordingly, a magnetic current parallel to the radiation direction flows through each of the pseudo-slot openings. Therefore, the radio waves radiated from the feed element 304 propagate in the radiation direction on the surface of the dielectric substrate 301 along the pseudo-slot openings between the front sub arrays, and are radiated in the endfire direction from a +X edge of the dielectric substrate 301. That is, the endfire antenna 303 operates using the pseudo-slot openings as magnetic current sources. In this case, the radio waves are aligned in phase at the +X edge of the dielectric substrate 301, and an equiphase wave plane appears at the +X edge. The parasitic elements of one of two adjacent front sub arrays, and the parasitic elements of the other of the two adjacent front sub array do not electromagnetically coupled to each other in the direction perpendicular to the radiation direction, and the parasitic elements of the front sub arrays do not resonate.

The plurality of front sub arrays are characterized in that the front sub arrays are arranged substantially in parallel to each other at certain intervals, so that the pseudo-slot openings are respectively formed between two adjacent front sub arrays to propagate a radio wave from the feed element 304 as magnetic currents.

Therefore, according to the endfire antenna 303, each front sub array operates as an electric wall, and the pseudo-slot openings are respectively formed between two adjacent front sub arrays. That is, since the endfire antenna 303 includes the plurality of parasitic elements equivalent to pieces of conductors divided from conductors extending in the radiation direction, the lengths of the conductors are shortened, and it is possible to reduce currents flowing along the pseudo-slot openings.

In each of the front sub arrays, the gap between two parasitic elements adjacent to each other in the radiation direction is set to, e.g., equal to or smaller than λ/8, so that the two parasitic elements are electromagnetically coupled to each other. In addition, the gap between two adjacent front sub arrays is set to, e.g., λ/10. In addition, a gap between the feed element 304, and the parasitic elements closest to the feed element 304 is set such that these elements are electromagnetically coupled to each other, and for example, is set to a value equal to the gap between two parasitic elements adjacent to each other in the radiation direction. A gap between the feed element 304 and the ground conductor 302 is set to, e.g., the gap between two parasitic elements adjacent to each other in the radiation direction.

Further, in each of the front sub arrays, by setting the gap between two parasitic elements adjacent to each other in the radiation direction as small as possible, the parasitic elements adjacent to each other in the radiation direction are strongly electromagnetically coupled to each other via a free space on the top surface of the dielectric substrate 301, and it is possible to reduce the density of the lines of electric force in the dielectric substrate 301. Therefore, it is possible to reduce the influence of the dielectric loss in the dielectric substrate 301. Therefore, it is possible to obtain higher gain characteristics than that of the prior art.

Further, according to the endfire antenna 303, it is possible to reduce currents generated in the parasitic elements by forming the parasitic elements 5 with a smaller size. In addition, in each of the front sub arrays, it is possible to reduce the dielectric loss in the dielectric substrate 301 by narrowing the gap between two parasitic elements adjacent to each other in the radiation direction. Therefore, it is possible to reduce the size of the endfire antenna 303, and to obtain high gain characteristics.

Therefore, according to the endfire antenna 303, it is possible to increase the power efficiency of a wireless communication apparatus for communication in frequency bands such as the millimeter-wave bands, within which a relatively large propagation loss in space occurs.

Referring to FIG. 2, the front array 305 is provided with five front sub arrays, but not limited thereto. The front array 305 may be provided with two or more front sub arrays arranged so as to form a plurality of pseudo-slot openings. The longer the length in the endfire direction of each front sub array is (the larger the number of parasitic elements 5 is), the narrower the beam width in the vertical plane (XZ-plane) becomes. In addition, the larger the number of front sub array is, the narrower the beam width in the horizontal plane (XY-plane) becomes. That is, the beam widths in the vertical and horizontal planes can be independently controlled by the length and number of the front sub array.

Next, the side arrays 306 and 307 are explained.

The radio frequency signal outputted from RF circuit 107 of FIG. 1 is fed to the feed element 304 via the feed line 111. When the feed element 304 is excited by feeding, an electric field is generated around the feed element 304 and around the respective parasitic elements of the front array 305. This electric field propagates in the radiation direction (+X direction) along the gaps between the parasitic elements of the front array 305. This electric field includes a component to be radiated as a radio wave, and a component (electric field E1) to propagate in directions perpendicular to the radiation direction (+Y direction and −Y direction). The electric field E1 propagated in the +Y direction and the −Y direction reach the parasitic elements of the side arrays 306 and 307.

The electric field E1 which has reached the side array 306 excites the respective parasitic elements of the side array 306, and then, newly produces an electric field E2 propagating in a direction along the longitudinal direction of the side array 306 (in a direction along the X axis of FIG. 2). As mentioned above, since the size of each parasitic element of the side array 306 satisfies the conditions explained with reference to FIG. 5 ($2\times Lp + Lg < \lambda/2$), the radio wave, which the parasitic elements of the side array 306 reradiates in the −Y direction, is very small, and can be ignored. In addition, since the electric field E1 change to the electric field E2 perpendicular to the electric field E1 before propagating in the −Y direction farther than the side array 306, the electric field E1 is largely attenuated by the parasitic elements of the side array 306, and does not propagates in the −Y direction farther than the side array 306.

Similarly, since the electric field E1 which has reached the side array 307 change to the electric field E2 perpendicular to the electric field E1, the electric field E1 is largely attenuated by the parasitic elements of the side array 307, and does not propagates in the +Y direction farther than the side array 307.

1.4. Example of Advantageous Effects

Figure 7:
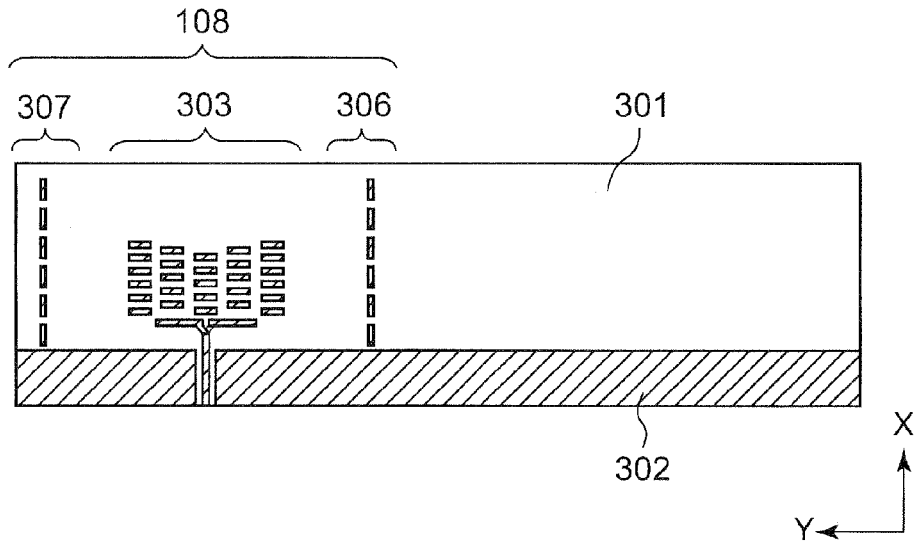
FIG. 7 is a plan view showing a configuration of an implementation example of the antenna apparatus 108 of FIG. 2.
Figure 8:
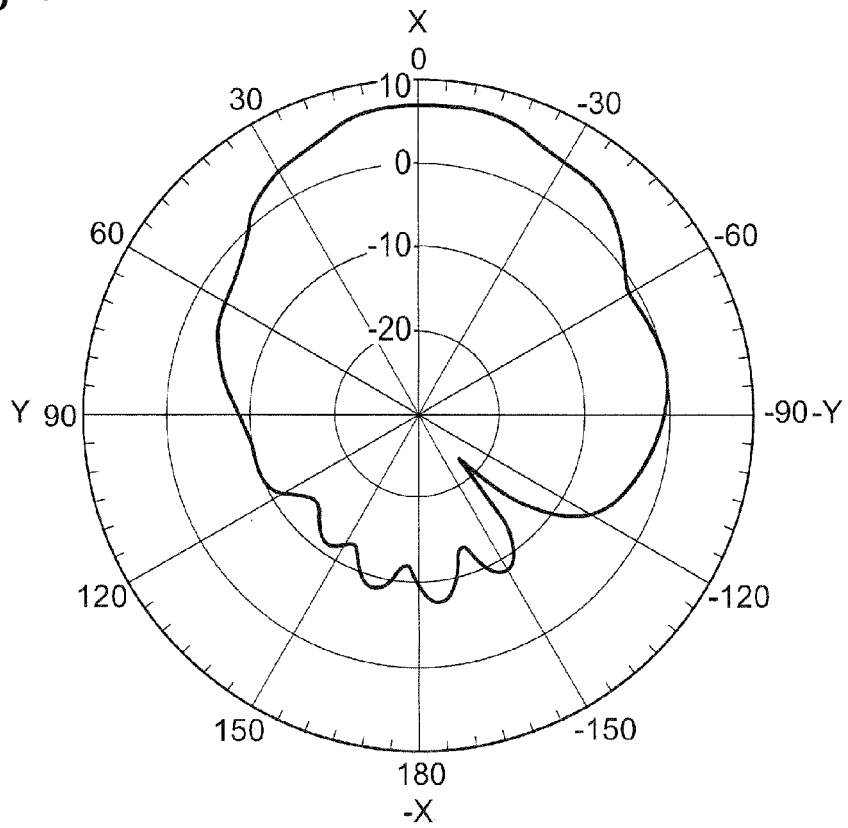
FIG. 8 is a radiation pattern diagram showing a result of an electromagnetic-field simulation of an antenna apparatus of FIG. 7.

FIG. 7 is a plan view showing a configuration of an implementation example of the antenna apparatus 108 of FIG. 2. FIG. 8 is a radiation pattern diagram showing a result of an electromagnetic-field simulation of an antenna apparatus of FIG. 7. In radiation pattern diagrams of FIG. 8 and others, the gain (radial scale) is indicated by "dBi". The antenna apparatus of FIG. 7 is provided with the endfire antenna 303 and the side arrays 306 and 307 of FIG. 2.

Figure 9:
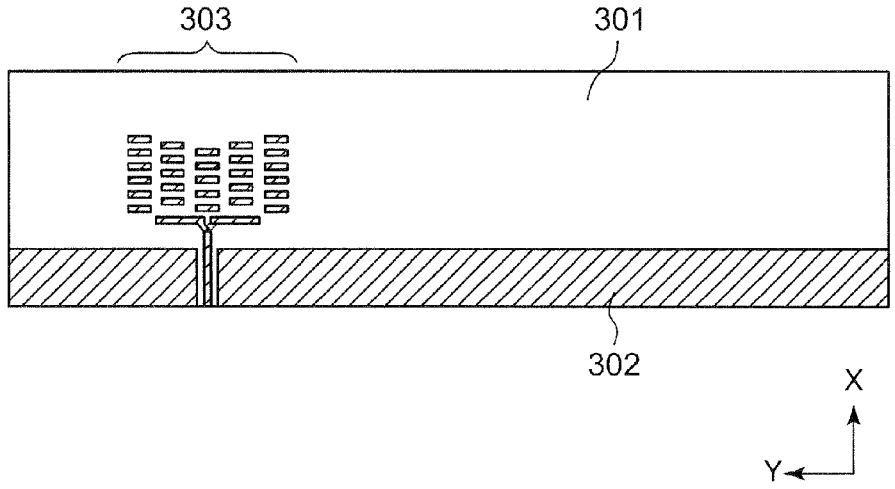
FIG. 9 is a plan view showing a configuration of an implementation example of an antenna apparatus according to a comparison example of the first embodiment.
Figure 10:
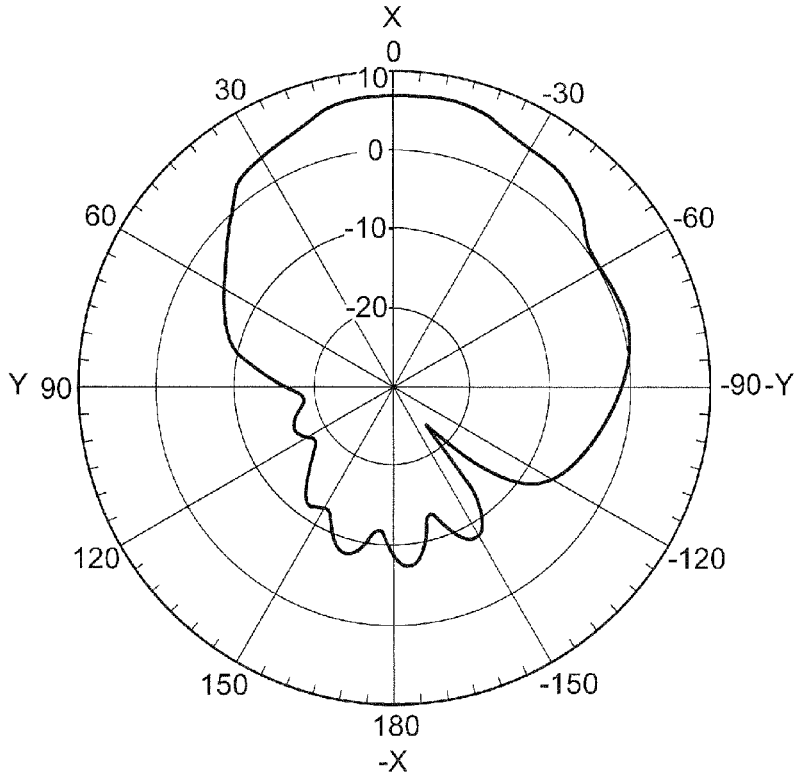
FIG. 10 is a radiation pattern diagram showing a result of an electromagnetic-field simulation of an antenna apparatus of FIG. 9.

FIG. 9 is a plan view showing a configuration of an implementation example of an antenna apparatus according to a comparison example of the first embodiment. FIG. 10 is a radiation pattern diagram showing a result of an electromagnetic-field simulation of an antenna apparatus of FIG. 9. The antenna apparatus of FIG. 9 is provided with the endfire antenna 303 of FIG. 2, and is not provided with the side arrays 306 and 307. Besides this, the antenna apparatus of FIG. 9 is configured in a manner similar to that of the antenna apparatus of FIG. 7.

With reference to FIGS. 8 and 10, the effects of the side arrays 306 and 307 are explained below.

According to the result of FIG. 8, it can be seen that the direction of a radiation beam of the antenna apparatus of FIG. 7 is approximately the same with a desired radiation direction (+X direction). On the other hand, according to the result of FIG. 10, it can be seen that the directions of a radiation beam of the antenna apparatus of FIG. 9 is inclined by about 30 degrees toward the −Y direction, than the result of FIG. 8. Therefore, it can be seen that with respect to the direction of the radiation beam, the antenna apparatus of FIG. 7 is less susceptible to surrounding conductors and dielectrics than the antenna apparatus of FIG. 9.

The inclination of the direction of the radiation beam of the antenna apparatus of FIG. 9 (directivity) is considered to result from an asymmetrical shape of the dielectric substrate 301 seen from the endfire antenna 303 in the +Y direction and in the −Y direction.

When the electric field propagates from the endfire antenna 303 in the +Y direction, it propagates on the dielectric substrate 301 to a +Y edge of the dielectric substrate 301, and propagates along the +Y edge to reach the +X edge. Similarly, when the electric field propagates from the endfire antenna 303 in the −Y direction, it propagates on the dielectric substrate 301 to a −Y edge of the dielectric substrate 301, and propagates along the −Y edge to reach the +X edge. However, with respect to the endfire antenna 303, an area in the −Y direction is wider than an area in the +Y direction. Therefore, a time required for the electric field propagated in the −Y direction to reach the +X edge is longer than a time required for the electric field propagated in the +Y direction to reach the +X edge. This means that the phase of the electric field propagated in the −Y direction is delayed at the +X edge. In general, the direction of the radiation beam inclines toward a side of an electric field with a delayed phase. Therefore, the inclination toward the −Y direction occurs as shown in FIG. 10.

On the other hand, in the antenna apparatus of FIG. 7, the electric field E1 propagating in the directions perpendicular to the desired radiation direction (+Y direction and −Y direction) changes to the electric field E2 propagating in the direction along the longitudinal direction of the side arrays 306 and 307, by the side arrays 306 and 307. Therefore, since the antenna apparatus of FIG. 7 is provided with the side arrays 306 and 307, both the electric fields propagated in the +Y direction and in the −Y direction from the endfire antenna 303 reach the +X edge of the dielectric substrate 301 in substantially the same propagation time. Therefore, it is possible to reduce a phase difference of the electric fields propagated in the +Y direction and in the −Y direction from the endfire antenna 303. As a result, as shown in FIG. 8, an inclination of the radiation beam can be reduced as compared with FIG. 10.

In addition, since the antenna apparatus of FIG. 7 is provided with the side arrays 306 and 307, it is possible to suppress propagation of the electric field E1 in the −Y direction than the side array 306, and propagation of the electric field E1 in the +Y direction than the side array 307. Therefore, in the antenna apparatus of FIG. 7, it is considered that the influence of the electric field propagating along the −Y edge of the dielectric substrate as in the antenna apparatus of FIG. 9 is small, and can be substantially ignored.

Thus, according to the antenna apparatuses 108 and 108A of the first embodiment, even when the shape of the dielectric substrate on which the antenna apparatus is provided is asymmetrical in the direction perpendicular to the radiation direction of the antenna apparatus, it is possible to suppress an inclination of the direction of the radiation beam by providing the side arrays 306 and 307.

1.5. Modified Embodiments

In the first embodiment, the case of using the dipole antenna as the feed element 304 is illustrated. However, the embodiments of the present disclosure are not limited thereto. The contents explained in the first embodiment can be applied to any antenna having horizontal polarization on a plane including a dielectric substrate (X-Y plane), and having one radiation direction (+X direction). Therefore, even when using, e.g., an inverted-F antenna, as a feed element, it is possible to achieve an antenna apparatus operable in a manner similar to that of the first embodiment.

The plurality of front sub arrays of the front array 305 may be provided such that in two adjacent front sub arrays, the respective parasitic elements of one front sub array, and the respective parasitic elements of the other front sub array are not located at alternate positions, but located to align along the direction perpendicular to the radiation direction (along the direction of the Y axis).

In the above explanation, as an example, the parasitic elements of the side arrays 306 and 307 are formed on only one layer of the printed circuit board. However, the embodiments according to the present disclosure are not limited thereto. The parasitic elements of the side arrays 306 and 307 may be provided on both sides of a printed circuit board, or in the middle layer, etc.

In addition, in the above described example, the parasitic elements of the side arrays 306 and 307 include the plurality of parasitic elements arranged along a substantially straight line. The embodiments according to the present disclosure are not limited thereto. The parasitic elements of each of the side arrays 306 and 307 may be arranged along a curve. The arrangement of the parasitic elements of the side arrays 306 and 307 is not specifically limited, as long as it is possible to limit a range where an electric field propagated from an antenna apparatus affects, or it is possible to cause an electric field to symmetrically propagate in a right and a left directions. For example, the parasitic elements of each of the side arrays 306 and 307 may be arranged along a substantially straight line at an angle to the radiation direction (+X direction).

In addition, FIG. 2 shows that the parasitic elements located at the most −X side among the parasitic elements of the side arrays 306 and 307 contact to the ground conductor 302, however, they may be located to separate from the ground conductor 302. Similarly, the parasitic elements located at the most +X side among the parasitic elements of the side arrays 306 and 307 are shown to reach (contact) to the +X edge of the dielectric substrate 301, however, they do not necessarily to reach (contact) the edge.

In the first embodiment, the example of the antenna apparatus adjusted for millimeter wave bands is shown. However, it is not limited to use a frequency of the millimeter wave bands.

As described above, in order to reduce the phase difference of the electric fields propagating in the directions perpendicular to the radiation direction (−Y direction and +Y direction) from the endfire antenna, the side arrays 306 and 307 are arranged symmetrically in the −Y direction and in the +Y direction of the endfire antenna. Thus, it is possible to reduce the phase difference of the electric fields propagating in the −Y direction and in the +Y direction, and, as a result, to reduce an inclination of the direction of the radiation beam.

2. Second Embodiment

In the following embodiments, only differences from the first embodiment will be described. For ease of explanation, explanations on features identical to that of the first embodiment will be omitted.

Figure 11:
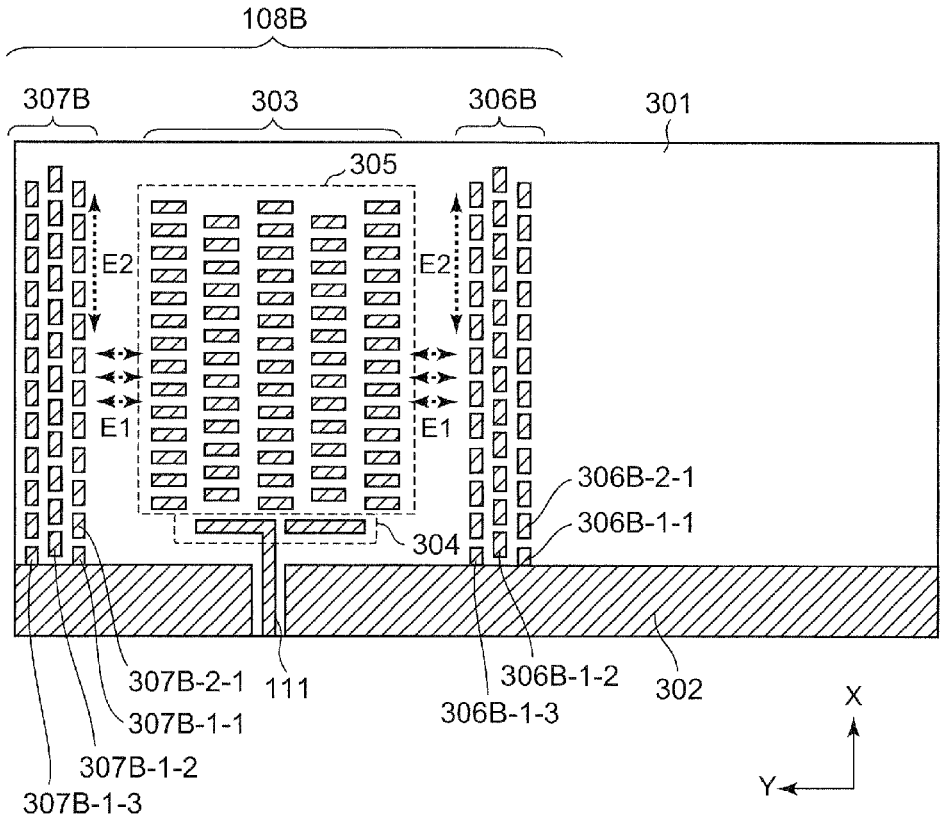
FIG. 11 is a plan view showing a configuration of an antenna apparatus 108B according to a second embodiment.

FIG. 11 is a plan view showing a configuration of an antenna apparatus 108B according to a second embodiment. The antenna apparatus 108B of FIG. 11 is provided with side arrays 306B and 307B each including a plurality of side sub arrays, instead of the side arrays 306 and 307 of FIG. 2.

2.1. Configuration

The plurality of parasitic elements of each of the side array 306B and 307B configure a plurality of side sub arrays, each of the front sub arrays including a plurality of parasitic elements which are aligned substantially along the radiation direction. Referring to FIG. 11, the side array 306B includes: a rightmost side sub array including parasitic element 306B-1-1, 306B-2-1, . . . , and so on; a middle side sub array including parasitic element 306B-1-2, 306B-2-2, . . . , and so on; and a leftmost side sub array including parasitic element 306B-1-3, 306B-2-3, . . . , and so on. The three side sub arrays of the side array 306B are provided in parallel to each other substantially along the radiation direction. In addition, referring to FIG. 11, the side array 307B includes: a rightmost side sub array including parasitic element 307B-1-1, 307B-2-1, . . . , and so on; a middle side sub array including parasitic element 307B-1-2, 307B-2-2, . . . , and so on; and a leftmost side sub array including parasitic element 307B-1-3, 307B-2-3, . . . , and so on. The three side sub arrays of the side array 307B are provided in parallel to each other substantially along the radiation direction.

With respect to each of the side sub arrays, since the size and arrangement of the parasitic elements are the same as those explained with reference to FIG. 5 of the first embodiment, and therefore, their explanations are omitted.

In addition, the leftmost side sub array of the side array 306B is arranged at a distance D1 from the feed element 304 and the front array 305 (i.e., from the −Y end of each parasitic element of the front array 305), in a manner similar to that explained in the first embodiment. Similarly, the rightmost side sub array of the side array 307B is arranged at a distance D2 from the feed element 304 and the front array 305 (i.e., from the +Y end of each parasitic element of the front array 305).

The plurality of side sub arrays of each of the side array 306B and 307B are provided such that in two adjacent side sub arrays, gaps between the parasitic elements of one side sub array, and gaps between the parasitic elements of the other side sub array are located at alternate positions. Thus, by arranging the parasitic elements of the side sub arrays, it is possible to more surely prevent the electric field E1 from propagating in the −Y direction than the side array 306B, and propagating in the +Y direction than the side array 307B, as compared with the case of not having a plurality of side sub arrays.

Figure 12:
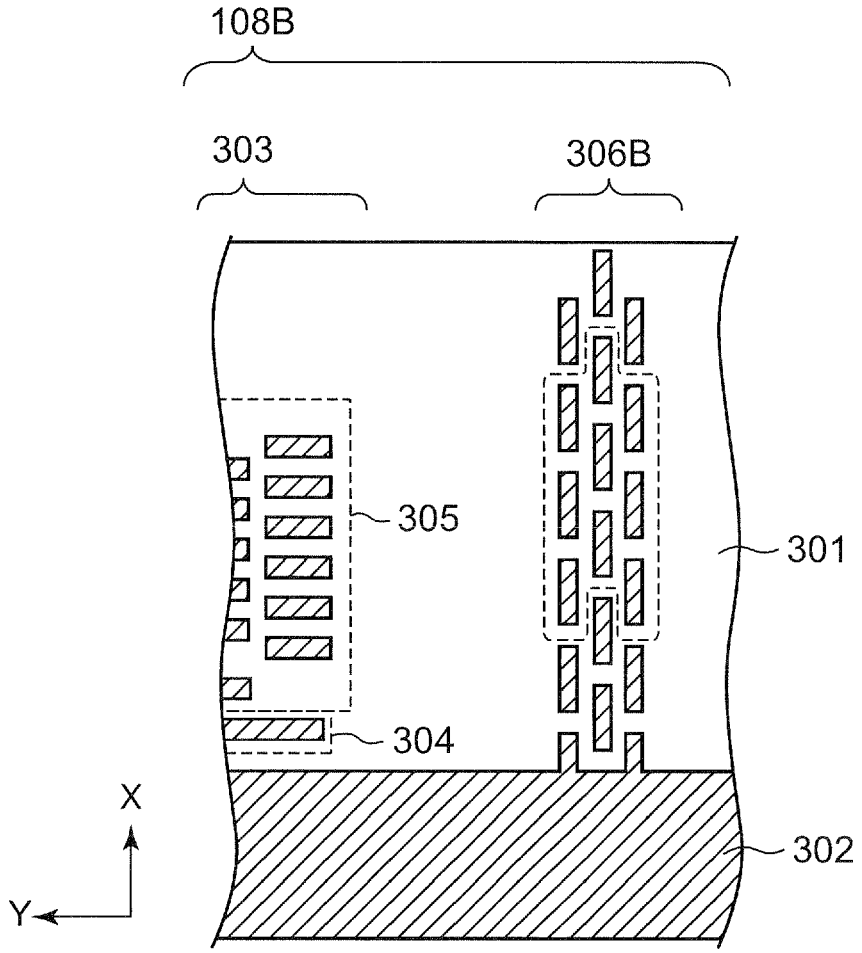
FIG. 12 is an enlarged view showing a part of the antenna apparatus 108 of FIG. 11.
Figure 13:
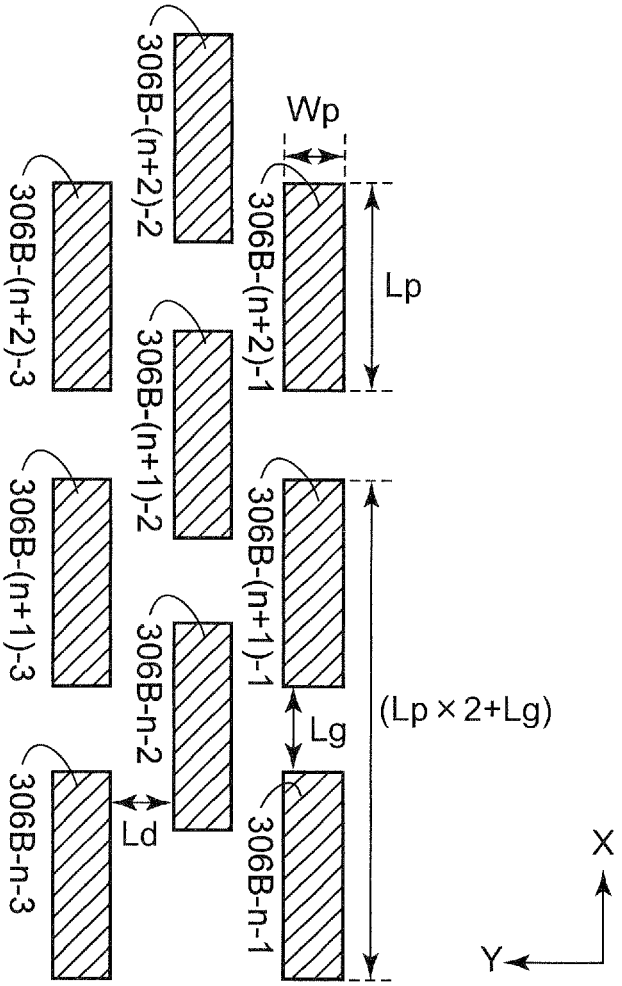
FIG. 13 is an enlarged view showing a part of parasitic elements of a side array 306B of FIG. 12.

FIG. 12 is an enlarged view showing a part of the antenna apparatus 108 of FIG. 11. FIG. 13 is an enlarged view showing a part of the parasitic elements of a side array 306B of FIG. 12. In each of the side arrays 306B and 307B, two adjacent side sub arrays are arranged with a certain distance Ld. This distance Ld is set to be as small as possible within a range available for manufacture using the patterning technology of printed circuit boards. Thus is because the smaller the distance Ld between the side sub arrays is, the higher the effect of suppressing leakage of the electric field becomes. For example, the distance Ld between side sub arrays is set to about a width Wp of each parasitic element of the side arrays 306B and 307B.

In addition, a distance D3 between both the side arrays 306B and 307B of the endfire antenna 303 is set to, e.g., about 1.5 times the operating wavelength λ of feed element 304, or more, as in a manner similar to that of the first embodiment. In this case, it is possible to prevent decrease in performance of the antenna apparatus 108 due to electromagnetic coupling between the feed element 304 and the parasitic elements of the side arrays 306B and 307B.

2.2. Example of Advantageous Effects

Figure 14:
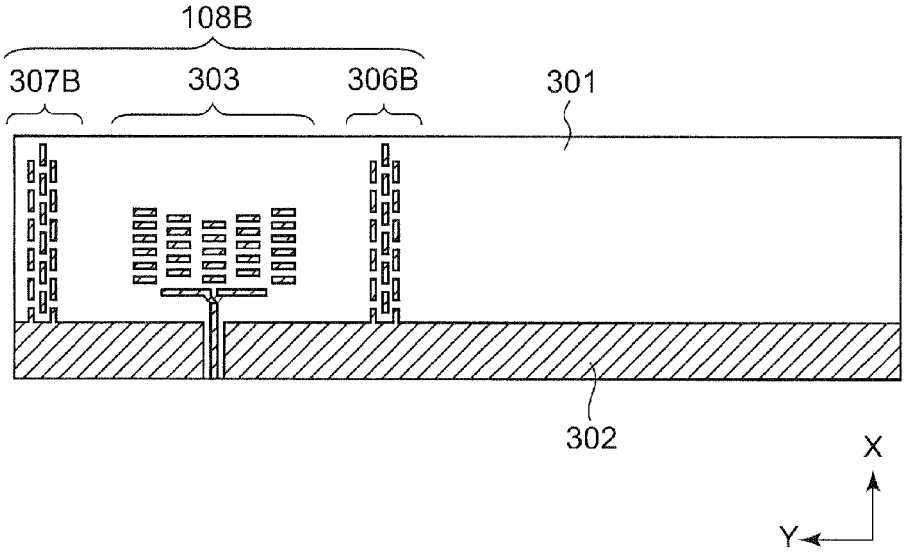
FIG. 14 is a plan view showing a configuration of an implementation example of the antenna apparatus 108 of FIG. 11.
Figure 15:
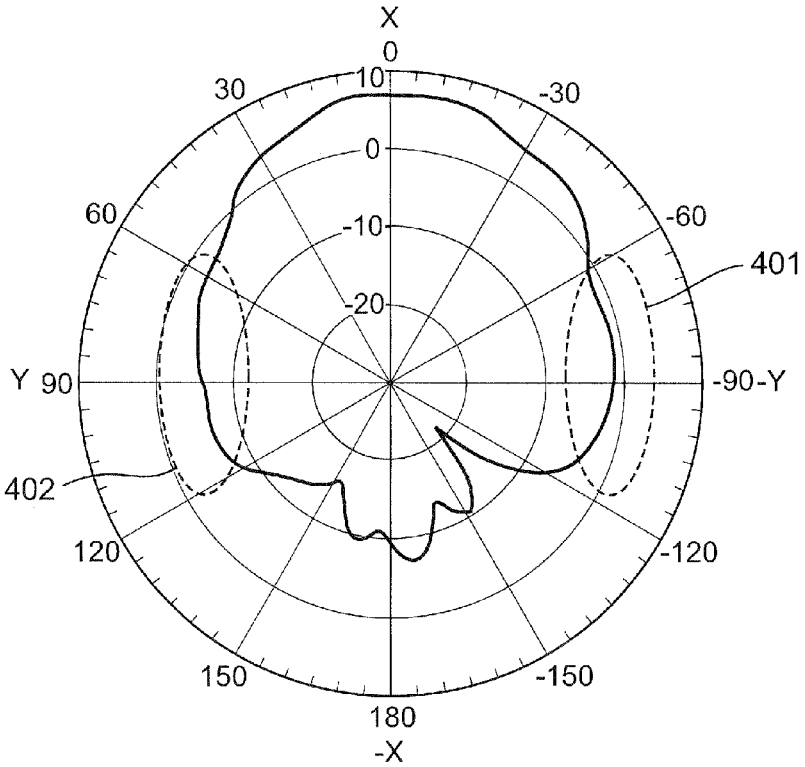
FIG. 15 is a radiation pattern diagram showing a result of an electromagnetic-field simulation of the antenna apparatus of FIG. 14.

FIG. 14 is a plan view showing a configuration of an implementation example of the antenna apparatus 108 of FIG. 11. FIG. 15 is a radiation pattern diagram showing a result of an electromagnetic-field simulation of the antenna apparatus of FIG. 14.

According to the result of FIG. 15, the direction of a radiation beam of the antenna apparatus of FIG. 14 is strongly directed in the +X direction. In addition, there is no inclination (bias) in the direction of the radiation beam as shown in FIG. 10. It is considered to result from symmetrical propagation of the electric field E1 on the dielectric substrate 301 in the +Y direction and in the −Y direction. Thus, it can be said that the side arrays 306B and 307B effectively operate in the antenna apparatus of FIG. 14, as in a manner similar to that of the first embodiment.

The radiation pattern diagram of FIG. 15 is more symmetrical in the +Y direction and in the −Y direction, even as compared with the radiation pattern diagram of FIG. 8 which is the result of the first embodiment. For example, in an area 401 of FIG. 15, a reduction in the +Y direction is seen as compared with a corresponding area in FIG. 8. In an area 402 of FIG. 15, an enhancement in the +Y direction is seen as compared with a corresponding area in FIG. 8. Considering a result of this comparison, the radiation beam of FIG. 15 is sharpened in the +X direction, as compared with the case of FIG. 8.

The above-mentioned result is considered to result from the fact that in the first embodiment, each of the side arrays 306 and 307 are provided with the plurality of parasitic elements aligned along a line, and on the other hand, in the second embodiment, the plurality of side sub arrays are provided to improve the effect of preventing leakage of the electric field E1.

2.3. Modified Embodiments

Although the distance Ld between side sub arrays of the second embodiment is set to about the width Wp of the parasitic element, the distance Ld can be set to any other length.

In the second embodiment, in two adjacent side sub arrays, gaps between the parasitic elements of one side sub array, and gaps between the parasitic elements of the other side sub array are located at alternate positions. However, the gaps do not need to be located at alternate positions. In the plurality of side sub arrays, all the positions of the gaps between the parasitic elements may be the same, or may differ from each other.

Although each of the side arrays 306B and 307B of the second embodiment include the three side sub arrays, they may include two side sub arrays, or four or more side sub arrays. However, comparing the first and second embodiments to each other, it is considered that the more the number of side sub arrays is, the more stable the direction of the radiation beam of the antenna apparatus is directed without inclining from a desired radiation direction (+X direction).

The number of the side sub arrays of the side array 306B may differ from the number of the side sub arrays of the side array 307B.

As described above in the second embodiment, it is possible to further stabilize the direction of the radiation beam of the antenna apparatus by increasing the number of the side sub arrays of each side array 306B and 307B.

3. Third Embodiment

In the third embodiment, a case in which a transmitting antenna and a receiving antenna are separately provided, and in particular, the transmitting antenna and the receiving antennas are provided close to each other is explained.

3.1. Configuration

Figure 16:
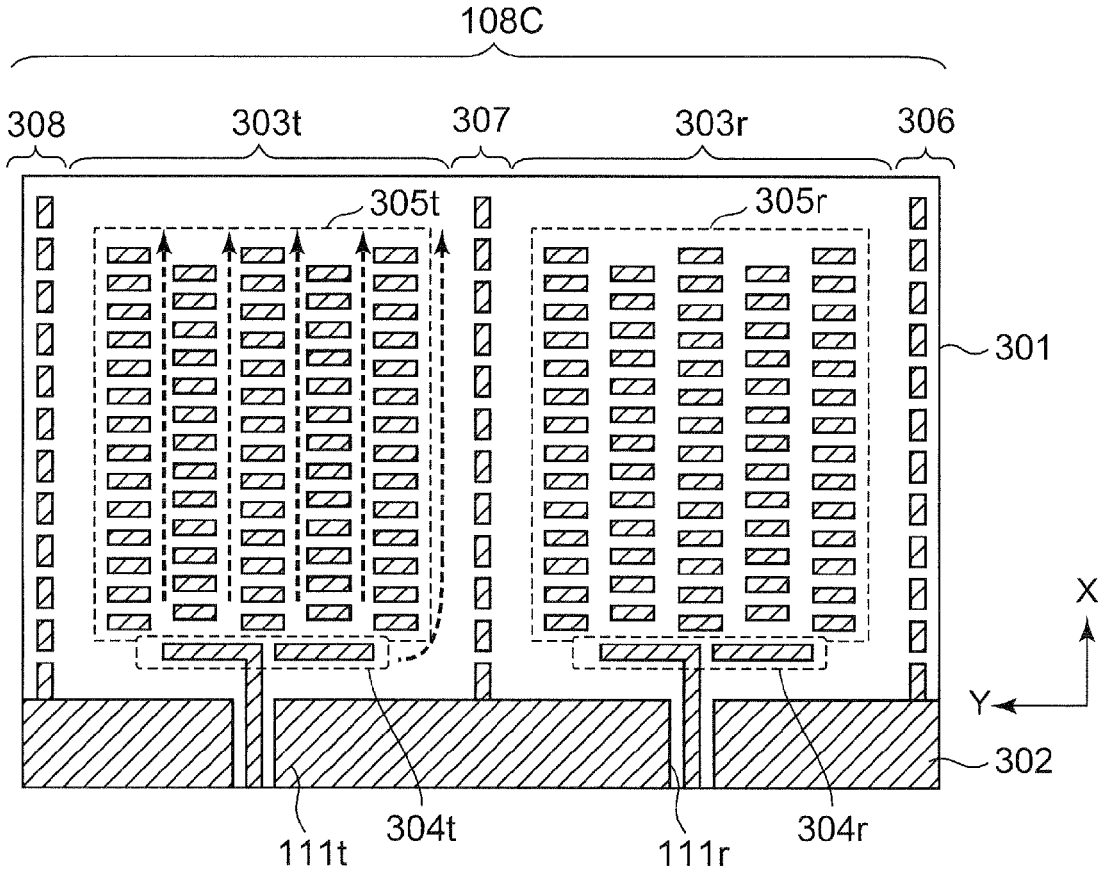
FIG. 16 is a plan view showing a configuration of an antenna apparatus 108C according to a third embodiment.

FIG. 16 is a plan view showing a configuration of an antenna apparatus 108C according to a third embodiment. The antenna apparatus 108C is provided with: feed elements 304*r* and 304*t* formed on the dielectric substrate 301 so as to align along a direction substantially perpendicular to the radiation direction; a front array 305*r* including a plurality of parasitic elements formed on the dielectric substrate 301 in an area located in the radiation direction with respect to the feed element 304*r*; and a front array 305*t* including a plurality of parasitic elements formed on the dielectric substrate 301 in an area located in the radiation direction with respect to the feed element 304*t*. The feed element 304*r* and the front array 305*r* operate as a receiving endfire antenna 303*r*. The feed element 304*t* and the front array 305*t* operate as a transmitting endfire antenna 303*t*.

Since the feed elements 304*r* and 304*t* are the same as the feed element 304 of the antenna apparatus 108 according to the first embodiment, their explanations are omitted.

On the dielectric substrate 301, the feed line 111*r* is formed for connecting the feed element 304*r* to the RF circuit 107 of FIG. 1, and the feed line 111*t* is formed for connecting the feed element 304*t* to the RF circuit 107. Lengths of the feed lines 111*r* and 111*t* are reduced as short as possible, because signal attenuation is more significant when increasing the line length (about 0.3 dB per 1 mm). Therefore, when reducing the lengths of the feed lines 111*r* and 111*t*, there is an increased possibility that the endfire antennas 303*r* and 303*t* approach to each other.

Since the front arrays 305*r* and 305*t* are the same as the front array 305 of the antenna apparatus 108 according to the first embodiment, their explanations are omitted.

The antenna apparatus 108C is further provided with at least one side arrays 306, 307, and 308 including a plurality of parasitic elements formed on the dielectric substrate 301 in at least an area located in a direction other than the radiation direction with respect to the feed elements 304*r* and 304*t*. One side array 307 is provided between a set of the feed element 304*r* and the front array 305*r*, and a set of the feed element 304*t* and the front array 305*t*.

Each of the side arrays 306, 307, and 308 is configured in a manner similar to that of the side arrays 306 and 307 of the first embodiment.

The antenna apparatus 108C according to the third embodiment is different from the antenna apparatuses according to the first and second embodiment, in that the two endfire antennas 303*r* and 303*t* are arranged to be close to each other and to align along a direction substantially perpendicular to a radiation direction. In addition, the side array 306 is arranged in the −Y direction with respect to endfire antenna 303*r*, the side array 307 is arranged between the endfire antennas 303*r* and 303*t*, and the side array 308 is arranged in the +Y direction with respect to the endfire antenna 303*t*.

Figure 17:
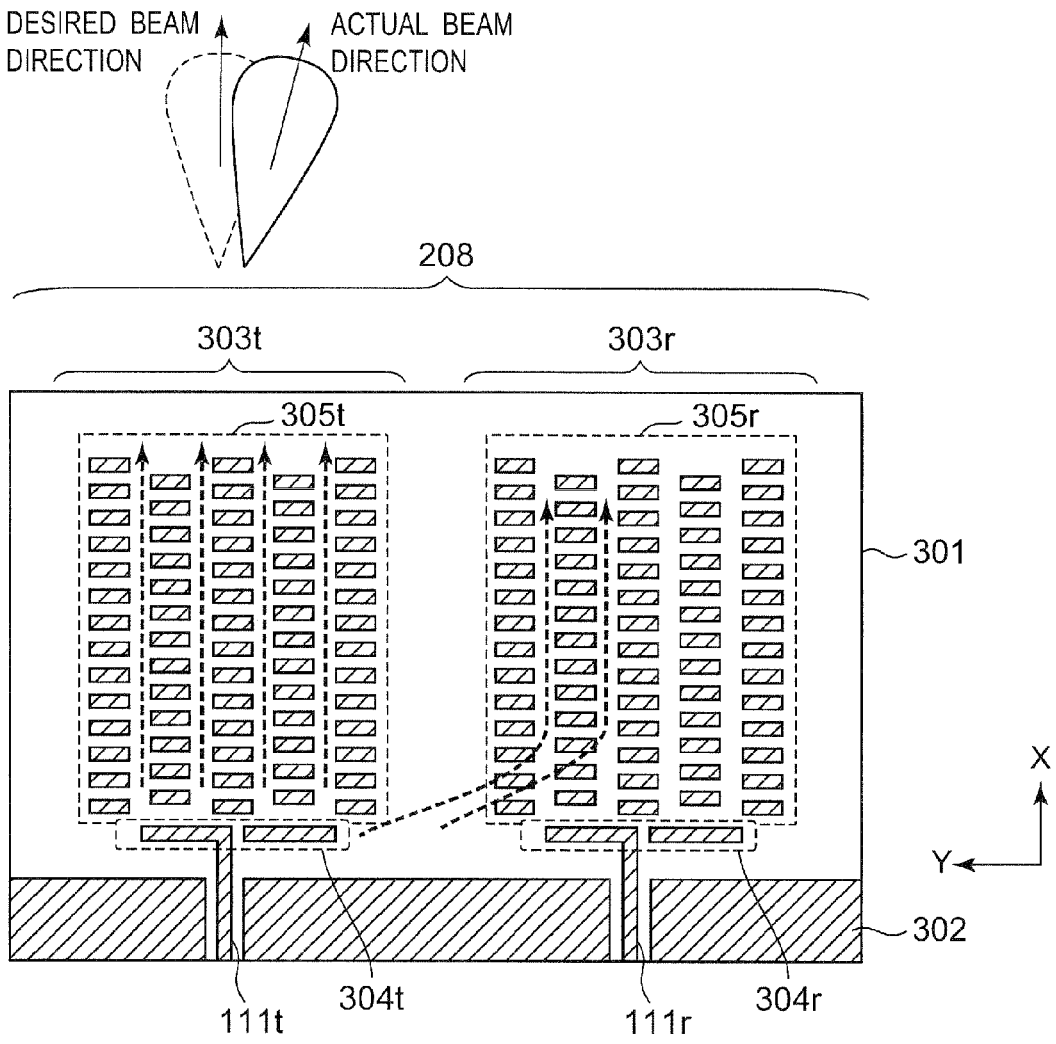
FIG. 17 is a plan view showing a configuration of an antenna apparatus 208 according to a comparison example of the third embodiment.

FIG. 17 is a plan view showing a configuration of an antenna apparatus 208 according to a comparison example of the third embodiment. The antenna apparatus 208 of FIG. 17 is configured by removing the side arrays 306, 307, and 308 from the antenna apparatus 108C of FIG. 16. FIG. 17 also indicates a direction of a radiation beam from the antenna apparatus 208 for explanation.

3.2. Operation

First, with reference to FIG. 17, the characteristics of the antenna apparatus of the comparison example are explained. The radio frequency signal outputted from RF circuit 107 of FIG. 1 is supplied to the feed element 304*t* via the feed line 111*t*. An electric field produced by exciting the feed element 304*t* propagates in the radiation direction (+X direction) along the gaps between the parasitic elements of the front array 305*t*, and is radiated as a radio wave. At this time, the electric field propagated in the −Y direction from the endfire antenna 303*t* goes into the gaps between the parasitic elements of the front array 305*r*, and propagates in the radiation direction (+X direction) along the gaps between the parasitic elements of the front array 305*r*. The electric field propagated through the front array 305*r* of the receiving endfire antenna 306*r* reaches the +X edge of the dielectric substrate 301 later than the electric field propagated through the front array 305*t* of the transmitting endfire antenna 306*t*. That is, at the +X edge of the dielectric substrate 301, a phase of the electric field propagated through the front array 305*t* differs from a phase of the electric field propagated through the front array 305*r*. Therefore, the direction of the radiation beam inclines toward a side of a later phase, i.e., to the −Y direction.

On the other hand, in the antenna apparatus 108C of FIG. 16, the side array 307 is provided between the endfire antennas 303*r* and 303*t*. The parasitic elements of the side array 307 changes an electric field E1 produced by the endfire antenna 303*t*, into an electric field E2 in a direction perpendicular to a direction of the electric field E1. Thus, the electric field E1 propagated in the −Y direction from the endfire antenna 303*t* is attenuated by the side array 307, and it is possible to reduce influence of the electric field E1 to the receiving endfire antenna 303*r*.

3.3. Example of Advantageous Effects

Figure 18:
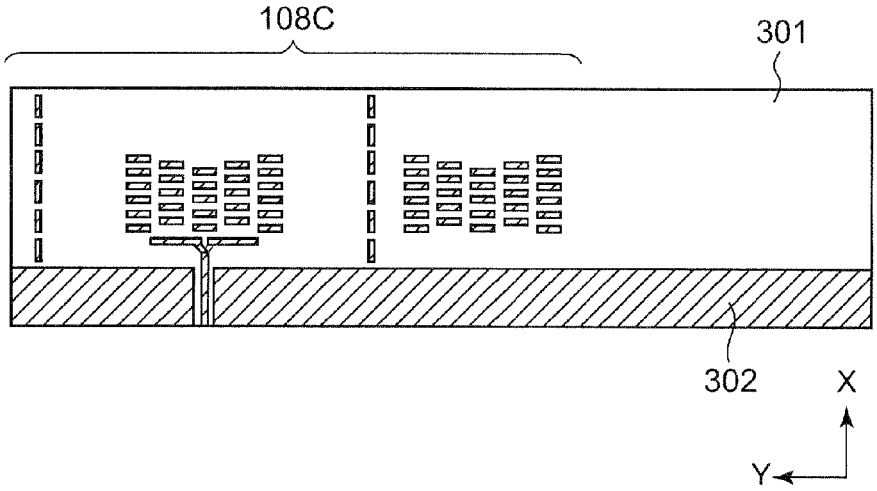
FIG. 18 is a plan view showing a configuration of an implementation example of the antenna apparatus 108C of FIG. 16.
Figure 19:
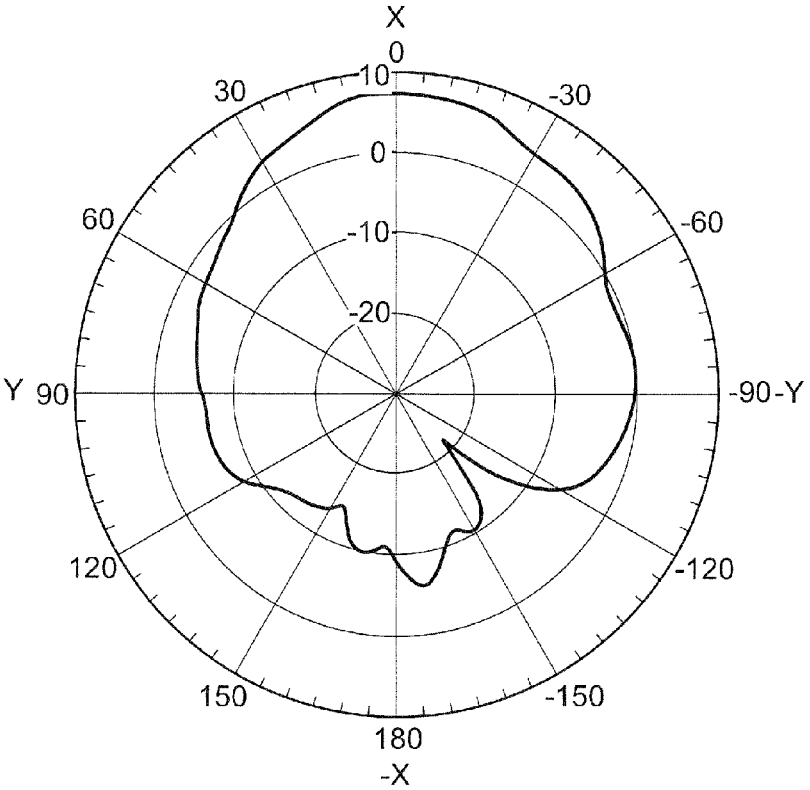
FIG. 19 is a radiation pattern diagram showing a result of an electromagnetic-field simulation of an antenna apparatus of FIG. 18.

FIG. 18 is a plan view showing a configuration of an implementation example of the antenna apparatus 108C of FIG. 16. FIG. 19 is a radiation pattern diagram showing a result of an electromagnetic-field simulation of an antenna apparatus of FIG. 18. The antenna apparatus of FIG. 18 is provided with the side arrays 307 and 308 of FIG. 16. In the antenna apparatus of FIG. 18, the side array 306, and the feed element 304*r* and the feed line 111*r* for reception are omitted.

Figure 20:
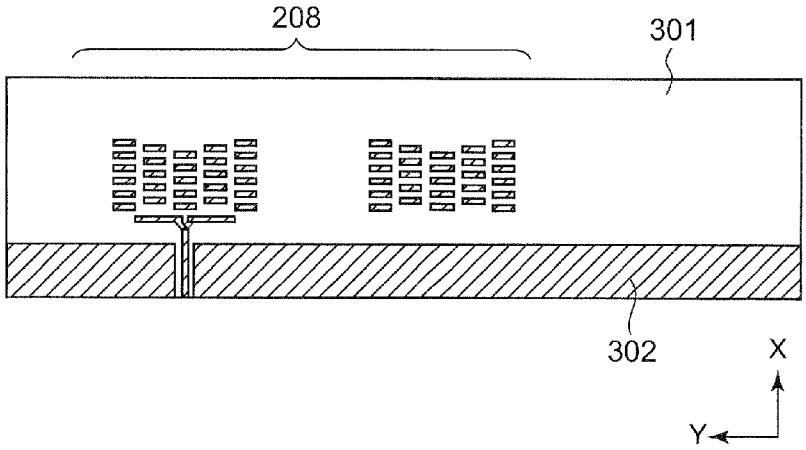
FIG. 20 is a plan view showing a configuration of an implementation example of the antenna apparatus 208 of FIG. 17.
Figure 21:
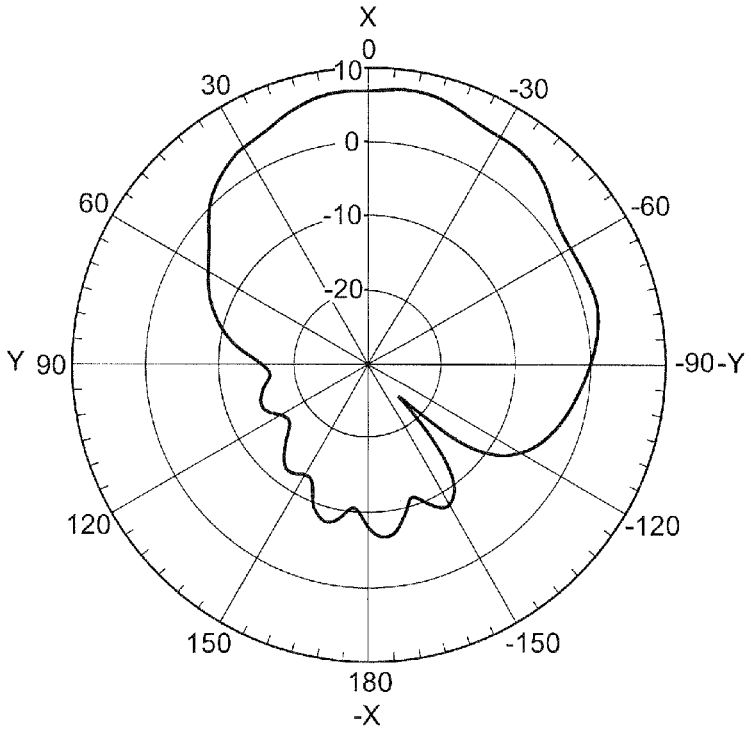
FIG. 21 is a radiation pattern diagram showing a result of an electromagnetic-field simulation of an antenna apparatus of FIG. 20.

FIG. 20 is a plan view showing a configuration of an implementation example of the antenna apparatus 208 of FIG. 17. FIG. 21 is a radiation pattern diagram showing a result of an electromagnetic-field simulation of an antenna apparatus of FIG. 20. The antenna apparatus of FIG. 20 is configured by removing the side arrays 306, 307, and 308 from the antenna apparatus of FIG. 18.

With reference to FIGS. 19 and 21, the effects of the side arrays 307 and 308 are explained below.

According to FIG. 21, it can be seen that in the case that there is no side array 307 between endfire antennas 303*r* and 303*t*, the direction of the radiation beam transmitted from the endfire antenna 303*t* is inclined toward the −Y direction (a side of the endfire antenna 303*r*). This is because, as described above, the side array 307 is not provided, the electric field E1 produced by the endfire antenna 303*t* excites the parasitic elements of the front array 305*r* of the endfire antenna 303*r*, and therefore, the parasitic elements of the front array 305*r* substantially operate as a part of the endfire antenna 303*t*. Therefore, the direction of the radiation beam is inclined toward a side of the endfire antenna 303*r*.

On the other hand, according to FIG. 19, in the case that the side array 307 is provided, the side array 307 prevents the electric field E1 produced by the endfire antenna 303*t* from reaching the endfire antenna 303*r*. Therefore, as shown in FIG. 19, the direction of the radiation beam of the endfire antenna 303*t* is the same with a desired radiation direction (+X direction).

3.4. Modified Embodiments

In the above described example of the third embodiment, although the two endfire antennas 303*t* and 303*r* have the same shape with each other, their shape is not limited thereto. The transmitting antenna and the receiving antenna may have different shapes or characteristics from each other.

In addition, in the above described example, the parasitic elements of the side arrays 306, 307, and 308 include the plurality of parasitic elements arranged along substantially straight lines. The embodiments according to the present disclosure are not limited thereto. The parasitic elements of each of the side arrays 306, 307, and 308 may be arranged along a curve. The arrangement of the parasitic elements of the side arrays 306, 307, and 308 is not specifically limited, as long as it is possible to limit a range where an electric field propagated from an antenna apparatus affects, or it is possible to cause an electric field to symmetrically propagate in a right and a left directions. For example, the parasitic elements of each of the side arrays 306, 307, and 308 may be arranged along a substantially straight line at an angle to the radiation direction (+X direction).

In addition, FIG. 16 shows that the parasitic elements located at the most −X side among the parasitic elements of the side arrays 306, 307, and 308 contact to the ground conductor 302. However, they may be located to separate from the ground conductor 302. Similarly, the parasitic elements located at the most +X side among the parasitic elements of the side arrays 306, 307, and 308 are shown to reach (contact) to the +X edge of the dielectric substrate 301, however, they do not necessarily to reach (contact) the edge.

In the third embodiment, the example of the antenna apparatus adjusted for millimeter wave bands is shown. However, it is not limited to use a frequency of the millimeter wave bands.

In the third embodiment, one of the two endfire antennas 303*t* and 303*r* is used for transmission and the other is used for reception. However, both the endfire antennas 303*t* and 303*r* may be used for transmission, for reception, or for transmission and reception. Similarly, three or more endfire antennas may be provided, and one or more of them may be used for transmission, for reception, or for transmission and reception.

As described above, by arranging the parasitic elements of the side array 307 between the two endfire antennas 303*t* and 303*r*, it is possible to prevent the electric field E1 produced by the transmitting endfire antenna 303*t*, from propagating through the receiving endfire antenna 303*r*, and prevent the direction of the radiation beam of the endfire antenna 303*t* from inclining from a desired radiation direction. In this case, the parasitic elements of the side array 307 are arranged to prevent the electric field E1 produced by the transmitting endfire antenna 303*t*, from reaching the endfire antenna 303*r*. In particular, the parasitic elements of the side array 307 are arranged so as to obtain effects of, e.g., changing the direction of the electric field E1 by the parasitic elements of the side array 307, or cancelling the electric field E1.

4. Fourth Embodiment

In the fourth embodiment, a case of providing only one of the side arrays 306 and 307 explained in the first embodiment, i.e., providing a side array in only one side of the endfire antenna 303 (one of +Y direction and −Y direction) is explained.

4.1. Configuration

Figure 22:
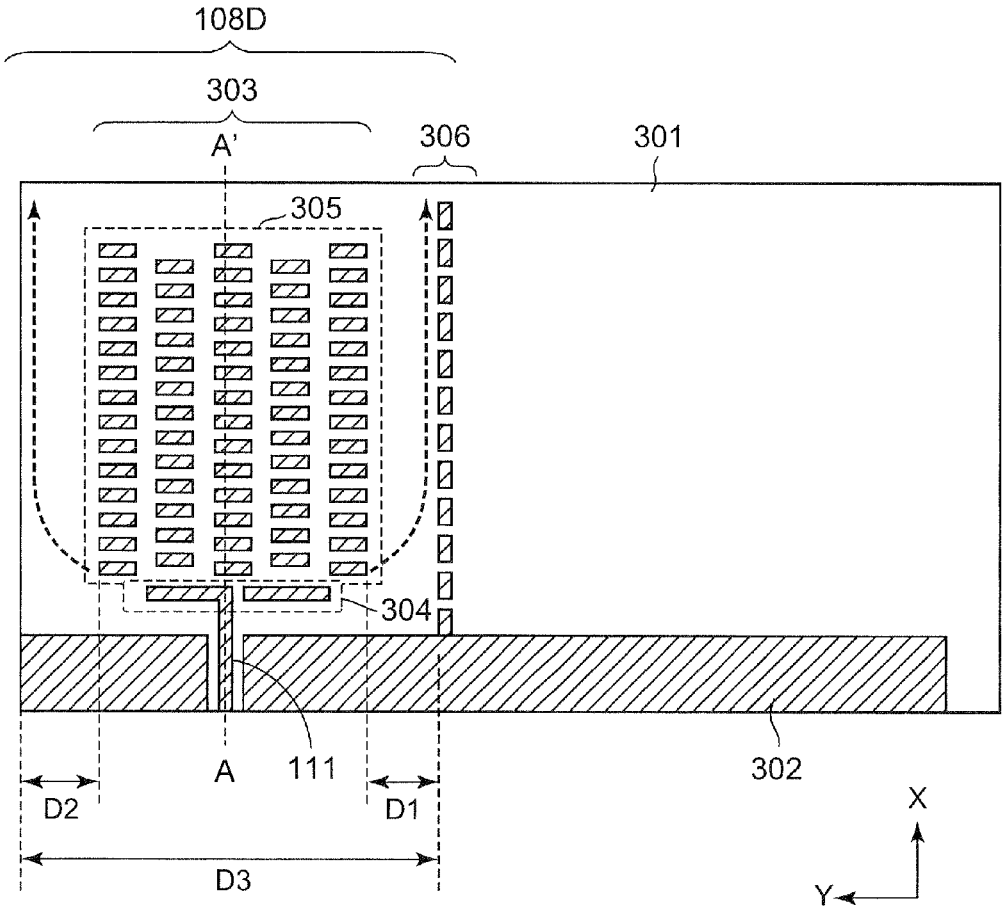
FIG. 22 is a plan view showing a configuration of an antenna apparatus 108D according to a fourth embodiment.

FIG. 22 is a plan view showing a configuration of an antenna apparatus 108D according to a fourth embodiment. The antenna apparatus 108D of FIG. 22 is configured by removing one side array 307 of the two side arrays 306 and 307 from the antenna apparatus 108 of FIG. 2. The antenna apparatus 308D is provided with one side array 306 provided in one side with respect to a reference axis A-A' extending from the feed element 304 toward the radiation direction (the side of −Y direction of FIG. 22).

Since the endfire antenna 303 is the same as the endfire antenna 303 explained in the first embodiment, its explanation is omitted.

Since the side array 306 is the same as the side array 306 explained in the first embodiment, its explanation is omitted.

A distance D1 from the feed element 304 and the front array 305 to the side array 306 is substantially equal to a the distance D2 from the feed element 304 and the front array 305 to a +Y edge of the dielectric substrate 301, in a side to which the side array is not provided, with respect to the reference axis.

4.2. Operation

The operation of the antenna apparatus 108D of FIG. 22 is explained. The radio frequency signal outputted from RF circuit 107 of FIG. 1 is supplied to the feed element 304 via the feed line 111. When the feed element 304 is excited by feeding, an electric field is generated around the feed element 304 and around the respective parasitic elements of the front array 305. This electric field propagates in the radiation direction (+X direction) along the gaps between the parasitic elements of the front array 305. This electric field includes a component to be radiated as a radio wave, and a component (electric field E1) to propagate in directions perpendicular to the radiation direction (+Y direction and −Y direction).

When the electric field E1 propagates from the endfire antenna 303 in the +Y direction, it propagates on the dielectric substrate 301 to the +Y edge of the dielectric substrate 301, and propagates along the +Y edge to reach the +X edge.

When the electric field E1 propagates from the endfire antenna 303 in the −Y direction, it propagates on the dielectric substrate 301 to reach the parasitic element of the side array 306. The electric field E1 is changed into an electric field E2 by the side array 306, the electric field E2 propagating in the direction along the longitudinal direction of the side array 306. The electric field E2 propagates along the longitudinal direction of the side array 306, and reach the +X edge.

According to the antenna apparatus 108D of FIG. 22, both the electric fields propagated in the +Y direction and in the −Y direction from the endfire antenna 303 reach the +X edge of the dielectric substrate 301 in substantially the same propagation time. As a result, a radiation direction is the same with the +X direction, without inclining toward the −Y direction nor the +Y direction.

4.3. Example of Advantageous Effects

Figure 23:
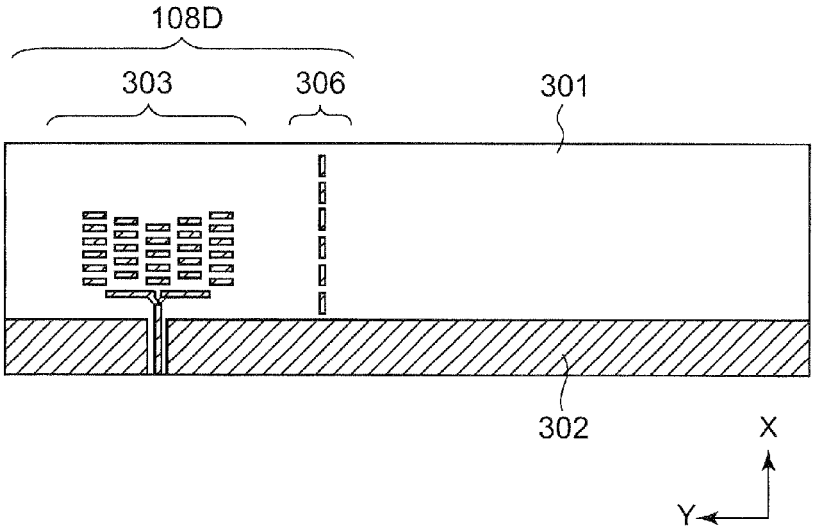
FIG. 23 is a plan view showing a configuration of an implementation example of the antenna apparatus 108D of FIG. 22.
Figure 24:
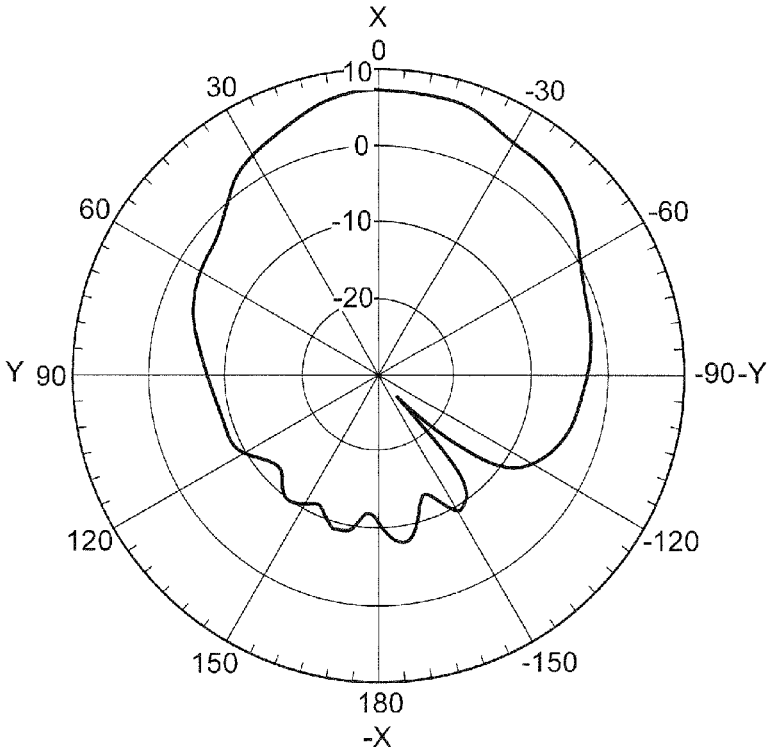
FIG. 24 is a radiation pattern diagram showing a result of an electromagnetic-field simulation of an antenna apparatus of FIG. 23.

FIG. 23 is a plan view showing a configuration of an implementation example of the antenna apparatus 108D of FIG. 22. FIG. 24 is a radiation pattern diagram showing a result of an electromagnetic-field simulation of an antenna apparatus of FIG. 23.

According to FIG. 24, the radiation beam of the antenna apparatus according to the fourth embodiment is more strongly directed in the +X direction, as compared with the radiation pattern diagram of FIG. 10. The inclination of the radiation beam toward the −Y side as shown in FIG. 10 is not observed. This means that the electric field propagates approximately symmetrically in the +Y direction and in the −Y direction on the dielectric substrate 301 of the antenna apparatus according to the fourth embodiment. The side array 306 of the antenna apparatus according to the fourth embodiment contributes to this symmetrical propagation of the electric field.

4.4. Modified Embodiments

In the example of the fourth embodiment, the case of providing the side array 306 in the −Y direction with respect to the endfire antenna 303 is explained. However, a side array may be provided in the +Y direction.

In addition, in the example of the fourth embodiment, the case that the side array 306 does not include a plurality of side sub arrays is explained. However, the side array 306 may include a plurality of side sub arrays as explained in the second embodiment.

In addition, in the example of the fourth embodiment, the parasitic elements of the side array 306 are arranged along substantially straight lines. However, the parasitic elements of the side array 306 may be arranged along a curve.

In addition, FIG. 22 shows that the parasitic element located at the most −X side among the parasitic elements of the side array 306 contacts to the ground conductor 302. However, it may be located to separate from the ground conductor 302. Similarly, the parasitic element located at the most +X side among the parasitic elements of the side array 306 is shown to reach (contact) to the +X edge of the dielectric substrate 301, however, it does not necessarily to reach (contact) the edge.

5. Summary of Embodiments

In the first to fourth embodiments, an antenna provide with a feed element and a group of parasitic elements (first parasitic element group) arranged substantially in parallel to the feed element is explained. The antenna outputs a radio wave from the feed element to the direction of the first parasitic element group, using the feed element and the first parasitic element group. Using a reference axis on a desired radiation direction, the antenna is further provided with a second parasitic element group and a third parasitic element group, the feed element and the first parasitic element group on the reference axis is arranged between the second and third parasitic element groups. The second and third parasitic element groups are arranged substantially in parallel to each other, the feed element and the first parasitic element group is arranged between the second and third parasitic element groups as described above.

Thus, an electric field leaking from the feed element and the first parasitic element group in a direction approximately perpendicular to the radiation direction is guided in the radiation direction by the second and third parasitic element groups. Therefore, it is possible to reduce a phase difference of the electric field at an output edge of the radio wave, and further direct the radio wave in the desired radiation direction.

The second and third parasitic element groups are configured, e.g., to make a leaked electric field symmetrically with respect to the reference axis in a right and a left directions. Thus, it is possible to further reduce a phase difference of the electric field reaching at the output edge, and therefore, further reduce inclination of the direction of the radio wave in a right and a left direction.

The second and third parasitic element groups are configured, e.g., to make the leaked electric field propagate substantially symmetrically with respect to the reference axis. Therefore, the second and third parasitic element groups are arranged, e.g., symmetrically with respect to the antenna including the feed element and the first parasitic element group. Therefore, the second and third parasitic element groups are arranged, e.g., at an substantially equal distance from the antenna including the feed element and the first parasitic element group.

Further, the second and third parasitic element groups may not necessarily be shaped substantially symmetrically with respect to the reference axis. The shape, etc. is not necessarily substantially symmetrical, as long as it is possible to reduce the phase difference or time difference of the electric field E2 reached at the output edge with respect to the reference axis.

Further, both the second and third parasitic element groups are not necessarily needed. Only one parasitic element group may be provided, as long as it is possible to adjust an electric field leaked from the feed element and the first parasitic element group by providing the one parasitic element group. No parasitic element group is provided at one edge of the dielectric substrate, and a parasitic element group is provided at only the other edge, as explained in the fourth embodiment.

6. Other Embodiments

As described above, the first and fourth embodiments have been explained as exemplary techniques of the present disclosure. However, the techniques of the present disclosure is not limited thereto, and be applied to embodiments with changes, substitutions, additions, omissions, etc. in an appropriate manner. In addition, the components explained in the first to fourth embodiments can be combined to provide a new embodiment.

As described above, the first to fourth embodiments have been explained as exemplary techniques of the present disclosure. The accompanying drawings and detailed explanation are provided for this purpose.

Therefore, the components indicated to the accompanying drawings and the detailed description may include not only components essential for solving the problem, but may include components for illustrating the techniques and not essential for solving the problem. Therefore, even if the accompanying drawings and the detailed description include such non-essential components, it should not be judged that the non-essential components are essential.

The above-described embodiments are provided for illustrating the techniques of the present disclosure, and therefore, various change, substitution, addition, and omission, etc. can be done within a scope of claims and their equivalence.

The contents of the present disclosure can be used for a wireless communication apparatus provided with an antenna apparatus requiring directivity.

The invention claimed is:

1. An antenna apparatus comprising:

a dielectric substrate;

a front array including a feed element and a plurality of parasitic elements, the feed element being formed on the dielectric substrate and having one radiation direction, and the plurality of parasitic elements being formed on the dielectric substrate in an area located in the radiation direction with respect to the feed element; and at least one side array including a plurality of parasitic elements formed on the dielectric substrate in at least an area located in a direction other than the radiation direction with respect to the feed element, wherein the plurality of parasitic elements of the front array configure a plurality of front sub arrays, each of the front sub arrays including a plurality of parasitic elements which are aligned along the radiation direction, wherein the plurality of front sub arrays are provided in parallel to each other along the radiation direction such that the respective parasitic elements of two adjacent front sub arrays are close to each other, and wherein the plurality of parasitic elements of each of the side array are aligned substantially along the radiation direction.

2. The antenna apparatus according to claim 1, wherein the respective parasitic elements of each of the side array have their longitudinal direction along a longitudinal direction of the side array, and wherein in each of the side array, a sum of lengths in the longitudinal direction of two parasitic elements adjacent in the longitudinal direction of the side array, and a length of a gap between the two parasitic elements is less than one half of an operating wavelength of the feed element.

3. The antenna apparatus according to claim 1, wherein the plurality of parasitic elements of each of the side array configure a plurality of side sub arrays, each of the side sub arrays including a plurality of parasitic elements which are aligned substantially along the radiation direction, wherein the plurality of side sub arrays are provided in parallel to each other substantially along the radiation direction.

4. The antenna apparatus according to claim 3, wherein the plurality of side sub arrays of each of the side array are provided such that in two adjacent side sub arrays, gaps between the parasitic elements of one side sub array, and gaps between the parasitic elements of the other side sub array are located at alternate positions.

5. The antenna apparatus according to claim 1, wherein the antenna apparatus comprises a first side array provided in one side with respect to a reference axis extending from the feed element toward the radiation direction, and a second side array provided in the other side with respect to the reference axis.

6. The antenna apparatus according to claim 5, wherein a distance from the feed element and the front array to the first side array is substantially equal to a distance from the feed element and the front array to the second side array.

7. The antenna apparatus according to claim 1, wherein the antenna apparatus comprises one side array provided in one side with respect to a reference axis extending from the feed element toward the radiation direction, and wherein a distance from the feed element and the front array to the side array is substantially equal to a the distance from the feed element and the front array to an edge of the dielectric substrate, in a side to which the side array is not provided, with respect to the reference axis.

8. The antenna apparatus according to claim 1, wherein the feed element is a dipole antenna having a longitudinal direction along a direction perpendicular to the radiation direction, and wherein the plurality of parasitic elements of the front array have their longitudinal direction along the direction perpendicular to the radiation direction.

9. The antenna apparatus according to claim 8, wherein the plurality of front sub arrays of the front array are provided such that in two adjacent front sub arrays, the respective parasitic elements of one front sub array, and the respective parasitic elements of the other front sub array are located at alternate positions.

10. The antenna apparatus according to claim 1 comprising:

a first and a second feed elements formed on the dielectric substrate so as to align along a direction substantially perpendicular to the radiation direction;

a first front array including a plurality of parasitic elements formed on the dielectric substrate in an area located in the radiation direction with respect to the first feed element; and a second front array including a plurality of parasitic elements formed on the dielectric substrate in an area located in the radiation direction with respect to the second feed element; and at least one side array including a plurality of parasitic elements formed on the dielectric substrate in at least an area located in a direction other than the radiation direction with respect to the first and second feed elements, and wherein one of the at least one side array is provided between a set of the first feed element and the first front array, and a set of the second feed element and the second front array.

11. A wireless communication apparatus comprising: an antenna apparatus; and a wireless communication circuit connected to the antenna apparatus, wherein the antenna apparatus comprising:

a dielectric substrate;

a front array including a feed element and a plurality of parasitic elements, the feed element being formed on the dielectric substrate and having one radiation direction, and the plurality of parasitic elements being formed on the dielectric substrate in an area located in the radiation direction with respect to the feed element; and at least one side array including a plurality of parasitic elements formed on the dielectric substrate in at least an area located in a direction other than the radiation direction with respect to the feed element, wherein the plurality of parasitic elements of the front array configure a plurality of front sub arrays, each of the front sub arrays including a plurality of parasitic elements which are aligned along the radiation direction, wherein the plurality of front sub arrays are provided in parallel to each other along the radiation direction such that the respective parasitic elements of two adjacent front sub arrays are close to each other, and wherein the plurality of parasitic elements of each of the side array are aligned substantially along the radiation direction.

12. An electronic apparatus comprising: a wireless communication apparatus; and a signal processing apparatus configured to process signals transmitted or received by the wireless communication apparatus, wherein the wireless communication apparatus comprises: an antenna apparatus; and a wireless communication circuit connected to the antenna apparatus wherein the antenna apparatus comprising:

a dielectric substrate;

a front array including a feed element and a plurality of parasitic elements, the feed element being formed on the dielectric substrate and having one radiation direction, and the plurality of parasitic elements being formed on the dielectric substrate in an area located in the radiation direction with respect to the feed element; and at least one side array including a plurality of parasitic elements formed on the dielectric substrate in at least an area located in a direction other than the radiation direction with respect to the feed element, wherein the plurality of parasitic elements of the front array configure a plurality of front sub arrays, each of the front sub arrays including a plurality of parasitic elements which are aligned along the radiation direction, wherein the plurality of front sub arrays are provided in parallel to each other along the radiation direction such that the respective parasitic elements of two adjacent front sub arrays are close to each other, and wherein the plurality of parasitic elements of each of the side array are aligned substantially along the radiation direction.

* * * * *